US011027755B2

(12) United States Patent
Golembiewski et al.

(10) Patent No.: US 11,027,755 B2
(45) Date of Patent: Jun. 8, 2021

(54) RAILROAD CAR TRUCK WITH WARP RESTRAINTS

(71) Applicant: Standard Car Truck Company, Rosemont, IL (US)

(72) Inventors: Ronald D. Golembiewski, Chicago, IL (US); Andrew J. Morin, Mokena, IL (US)

(73) Assignee: Standard Car Truck Company, Rosemont, IL (US)

( * ) Notice: Subject to any disclaimer, the term of this patent is extended or adjusted under 35 U.S.C. 154(b) by 226 days.

(21) Appl. No.: 16/175,064

(22) Filed: Oct. 30, 2018

(65) Prior Publication Data

US 2019/0168786 A1 Jun. 6, 2019

Related U.S. Application Data

(60) Provisional application No. 62/594,283, filed on Dec. 4, 2017.

(51) Int. Cl.

| | |
|---|---|
| ***B61F 5/38*** | (2006.01) |
| ***B61F 5/04*** | (2006.01) |
| ***B61F 3/08*** | (2006.01) |

(52) U.S. Cl.

CPC ..... *B61F 5/383* (2013.01); *B61F 3/08* (2013.01); *B61F 5/04* (2013.01)

(58) Field of Classification Search

CPC ..... B61F 3/00; B61F 3/08; B61F 5/00; B61F 5/38; B61F 5/383; B61F 5/04; B61F 5/08; B61F 5/10; B61F 5/16; B61F 5/24; B61F 5/26

See application file for complete search history.

(56) References Cited

U.S. PATENT DOCUMENTS

| | | | | | |
|---|---|---|---|---|---|
| 169,663 | A | * | 11/1875 | Wells | A42C 1/04 223/15 |
| 174,232 | A | * | 2/1876 | Greenleaf | B07B 9/02 209/36 |
| 1,414,962 | A | * | 5/1922 | Kadel | B61F 5/40 105/179 |
| 2,696,176 | A | * | 12/1954 | Dath | B61F 5/122 105/198.2 |
| 3,782,294 | A | * | 1/1974 | Sundby | B61F 5/10 105/190.1 |
| 4,244,298 | A | * | 1/1981 | Hawthorne | B61F 5/122 105/198.4 |
| RE31,008 | E | | 8/1982 | Barber | |

(Continued)

FOREIGN PATENT DOCUMENTS

EP 2647541 B1 11/2016

OTHER PUBLICATIONS

Korean Intellectual Property Office, "International Search Report and Written Opinion" from corresponding application PCT/US2018/063776 (13 pages).

*Primary Examiner* — Jason C Smith
(74) *Attorney, Agent, or Firm* — McCoy Russell LLP

(57) ABSTRACT

A railroad car truck including a first side frame, a second side frame, a bolster, and a first plurality of warp restraints, each first warp restraint configured to prevent warping of the bolster relative to the side frames. Various embodiments include opposing bearings of each warp restraint that engage each other.

15 Claims, 17 Drawing Sheets

(56) References Cited

U.S. PATENT DOCUMENTS 4,363,276 A * 12/1982 Neumann ..... B61F 5/52 105/198.2
4,793,720 A * 12/1988 Merker, Jr. ..... B61F 5/142 384/423
4,917,021 A * 4/1990 Murphy ..... B61D 3/182 105/225
5,107,773 A * 4/1992 Daley ..... B61F 5/14 105/185
5,682,822 A * 11/1997 Sunderman ..... B61F 5/142 105/199.3
5,806,435 A * 9/1998 Pitchford ..... B61F 5/14 105/199.3
6,125,767 A * 10/2000 Hawthorne ..... B61F 5/52 105/182.1
6,142,082 A * 11/2000 Burke ..... E05D 15/0665 105/377.09
6,817,301 B1 * 11/2004 Bullock ..... B61F 5/04 105/182.1
7,096,795 B2 * 8/2006 Wike ..... B61F 5/36 105/168
7,174,837 B2 * 2/2007 Berg ..... B61F 5/122 105/197.05
7,665,622 B2 * 2/2010 Anderson ..... B61G 7/12 213/20
2004/0020403 A1 * 2/2004 Forbes ..... B61F 5/30 105/218.1
2007/0169663 A1 * 7/2007 Berg ..... B61F 5/36 105/206.1
2017/0129510 A1 * 5/2017 Golembiewski ..... B61F 5/32
2017/0174232 A1 * 6/2017 Morin ..... B61F 5/38
2019/0168786 A1 * 6/2019 Golembiewski ..... B61F 5/04
2019/0185030 A1 * 6/2019 Morin ..... B61F 3/08
2019/0185031 A1 * 6/2019 Golembiewski ..... B61F 5/122

* cited by examiner

RAILROAD CAR TRUCK WITH WARP RESTRAINTS

PRIORITY CLAIM

This application claims priority to and the benefit of U.S. Provisional Patent Application No. 62/594,283, filed Dec. 4, 2017, the entire contents of which are incorporated herein by reference.

BACKGROUND

Conventional freight railroad cars in North America and other parts of the world typically include a car body and two spaced apart trucks. The car body or car body under frame typically includes two spaced apart center plates that respectively rest on and are rotatably or swivelly received by bolster bowls of the two trucks. The trucks rollingly support the car body along railroad tracks or rails. Each truck typically has a three piece truck configuration that includes two spaced apart parallel side frames and a bolster. The side frames extend in the same direction as the tracks or rails, and the bolster extends transversely or laterally to the tracks or rails. The bolster extends laterally through and between and is supported by the two spaced apart side frames. Each side frame typically defines a center opening and pedestal jaw openings on each side of the center opening. Each end of each bolster is typically supported by a spring group positioned in the center opening of the side frame and supported by the lower portion of the side frame that defines the center opening.

Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel. The bearing adapters permit relatively slight angular displacement of the axles. The spring sets or groups permit the bolster to move somewhat with respect to the side frame, about longitudinal or horizontal, vertical, and transverse axes (and combinations thereof).

Directions and orientations herein refer to the normal orientation of a railroad car in use. Thus, unless the context clearly requires otherwise, the "longitudinal" axis or direction is substantially parallel to straight tracks or rails and in the direction of movement of the railroad car on the track or rails in either direction. The "transverse" or "lateral" axis or direction is in a horizontal direction substantially perpendicular to the longitudinal axis and the straight tracks or rails. "Vertical" is the up-and-down direction, and "horizontal" is a plane parallel to the tracks or rails including the transverse and longitudinal axes. A truck is considered "square" when its wheels are aligned on parallel rails and the axles are parallel to each other and perpendicular to the side frames. The "leading" side of the truck means the first side of a truck of a railroad car to encounter a turn; and the "trailing" side is opposite the leading side.

Existing trucks do not fully address the ever increasing and expected future demands for freight railroad car truck performance in the railroad industry. More specifically, while the various current known and commercially available three piece truck configurations meet current Association of American Railroads ("AAR") specifications, enhanced specifications are being developed by the AAR and it is expected that the current three piece truck configurations may not meet these new AAR specifications. These AAR enhanced specifications set forth or codify these continuing and ongoing demands in the railroad industry for improved freight railroad car truck performance to: (a) reduce railroad car component wear and damage such as wheel wear and damage; (b) reduce rolling resistance; (c) reduce fuel consumption; (d) reduce the need for and thus cost of railroad track or rail repair (including reducing the cost of rail and tie maintenance); (e) reduce truck hunting and improve high speed stability ("HSS") for both empty and loaded railroad cars; and (f) improve curving performance for both empty and loaded railroad cars.

Ideally, on straight tracks or straight rails, a three piece truck with parallel side frames and parallel wheel set axles perpendicular to the side frames (i.e., a perfectly "square" truck) rolls without inducing lateral or transverse forces between the wheel tread and the rail. However, at higher speeds, even minor imperfections or perturbations in the tracks or rails or in the equipment can lead to a condition known as "hunting" that refers to a yawing or oscillating lateral movement of the wheel sets along the tracks or rails that causes the railroad car to move side-to-side on the tracks or rails. More than minor imperfections or perturbations in the tracks or rails or in the railroad car equipment or components can lead to greater truck hunting even at lower speeds. Hunting tends to increase wheel wear and damage, increase fuel consumption, increase the need for railroad track or rail repair, and decrease HSS. In certain instances, hunting has also led to derailments, damage to the lading, and damage to the freight railroad cars.

Curved railroad tracks or rails pose a different set of challenges for the standard three-piece truck. When a railroad car truck encounters a curve or turn, the distance traversed by the wheels on the outside of the curve is greater than the distance traversed by wheels on the inside of the curve, resulting in lateral and longitudinal forces between the respective wheels and the tracks or rails. These wheel forces often cause the wheel set to turn in a direction opposing the curve or turn. On trucks with insufficient rigidity, this can result in a condition variously known as "warping," "lozenging," "parallelogramming," and/or "unsquaring," wherein the side frames remain parallel, but one side frame moves forward with respect to the other side frame. This condition is referred to herein as warping for brevity.

Another known issue relates to various known 3-piece railroad truck suspensions that have side frames with flat rectangular surfaces against which friction wedges are pressed to produce frictional (i.e., Coulomb) damping to control vertical bounces and other oscillatory modes. Normally, significant clearance exists between the side frame's column face and nearby surfaces of the bolster to enable assembly and proper relative motion during use. This clearance is undesirable in that it enables the truck assembly to become warped or change shape from the intended parallel and perpendicular arrangement (i.e., to undergo warping).

Such warping (alone or in combination with hunting) can cause increased wear on the tracks or rails and railroad car truck components or equipment. Such warping (alone or in combination with hunting) also tends to increase rolling resistance that increases railroad car fuel consumption, decreases railroad car efficiency, and increases railroad engine pollution.

Accordingly, there is a need to meet these ongoing demands in the railroad industry for improved freight railroad car truck performance that reduces or minimizes warping.

SUMMARY

Various embodiments of the present disclosure provide a new railroad car, and more particularly a new railroad car having a new railroad car truck with warp restraints that reduces, inhibits, and/or minimizes the above warping related problems.

In various embodiments, the railroad car truck with warp restraints of the present disclosure includes a first side frame, a second side frame, a bolster, and a plurality of warp restraints. In various embodiments, each warp restraint includes a first bearing connected to or integrally formed as part of the bolster and a second opposing bearing connected to or integrally formed as part of the side frame. In various embodiments, the warp restraints are each positioned to reduce, inhibit, or minimize warping of the railroad car truck of the present disclosure.

More specifically, in various embodiments, the railroad car truck of the present disclosure has four such warp restraints including: (1) a first plurality or set of warp restraints at a first end portion of the bolster and at the first side frame; and (2) a second plurality or set of warp restraints at a second end portion of the bolster and at the second side frame. For the first plurality of warp restraints, each first warp restraint includes a first bearing connected to or integrally formed with a first portion of the bolster and a second opposing bearing connected to or integrally formed with the first side frame. For the second plurality of warp restraints, each second warp restraint includes a first bearing connected to or integrally formed with a second portion of the bolster and a second opposing bearing connected to or integrally formed with the second side frame.

In other various embodiments, the railroad car truck of the present disclosure has eight such warp restraints including: (1) a first plurality or set of warp restraints at a first end portion of the bolster and at the first side frame; and (2) a second plurality or set of warp restraints at a second end portion of the bolster and at the second side frame.

The opposing bearings of each warp restraint apply opposing forces to the side frames and bolster to reduce, inhibit, and/or minimize warping. More specifically, when the bolster moves from a square or perpendicular position relative to the side frames (or relative to each respective side frame), the respective warp restraints independently and in various groups or combinations co-act to apply opposing biasing forces to the bolster and the side frames to cause the bolster and/or side frames to move in the respective opposing direction and return to their normal square, perpendicular, or substantially perpendicular positions relative to each other, and thus act or co-act to reduce, inhibit, and/or minimize warping as further described below. It should also be appreciated that although the warp restraints of the present disclosure are not primarily intended to produce resistance against other directional movements of the bolster relative to the side frames, in various circumstances and embodiments, the warp restraints of the present disclosure can act or co-act to permit certain directional movements and act or co-act to reduce, inhibit, and/or minimize certain other directional movements alone or in combination with other components of the railroad car truck (such as but not limited to friction wedges that provide vertical dampening or gibs that provide lateral restraint).

It should be appreciated that that warp restraints of the present disclosure are in addition to the various other conventional components of a conventional railroad car truck.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
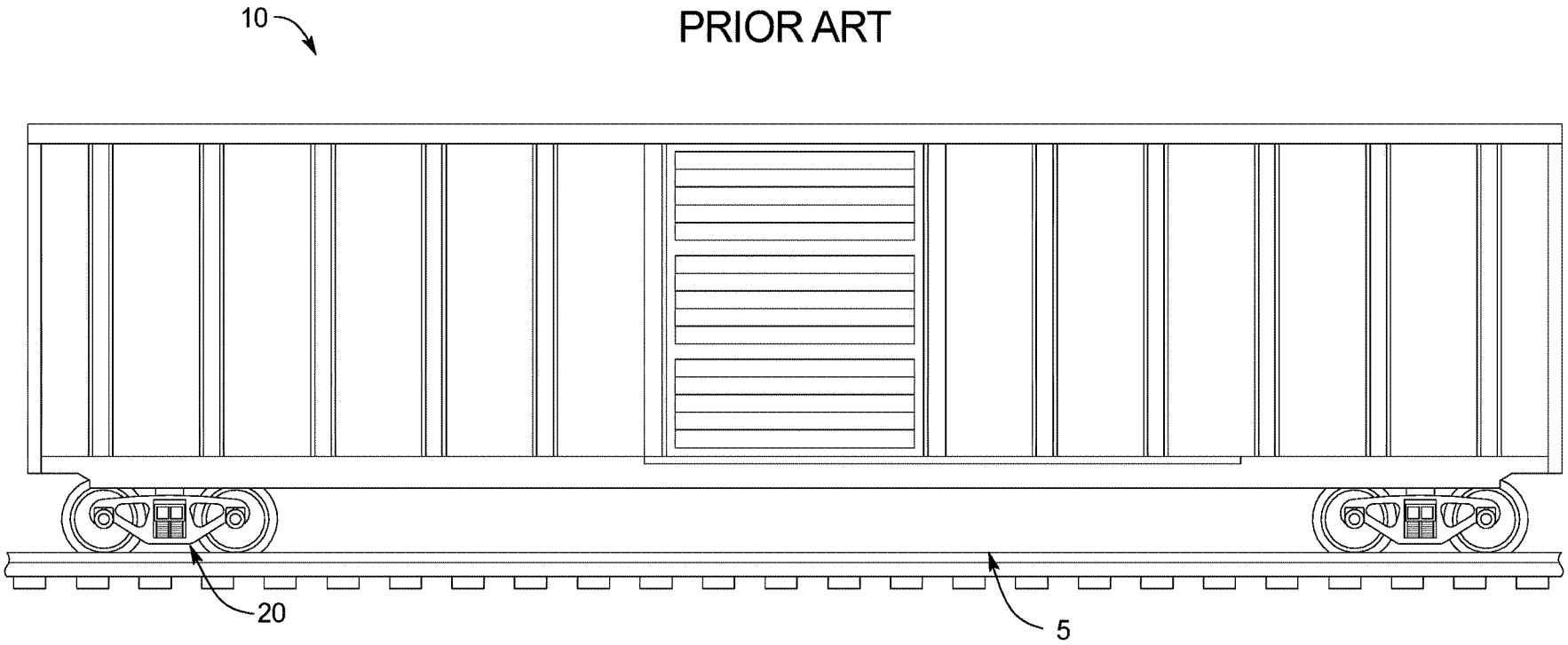
FIG. 1 PRIOR ART
FIG. 1 is a side view of a conventional freight railroad car positioned on conventional railroad tracks.
Figure 2:
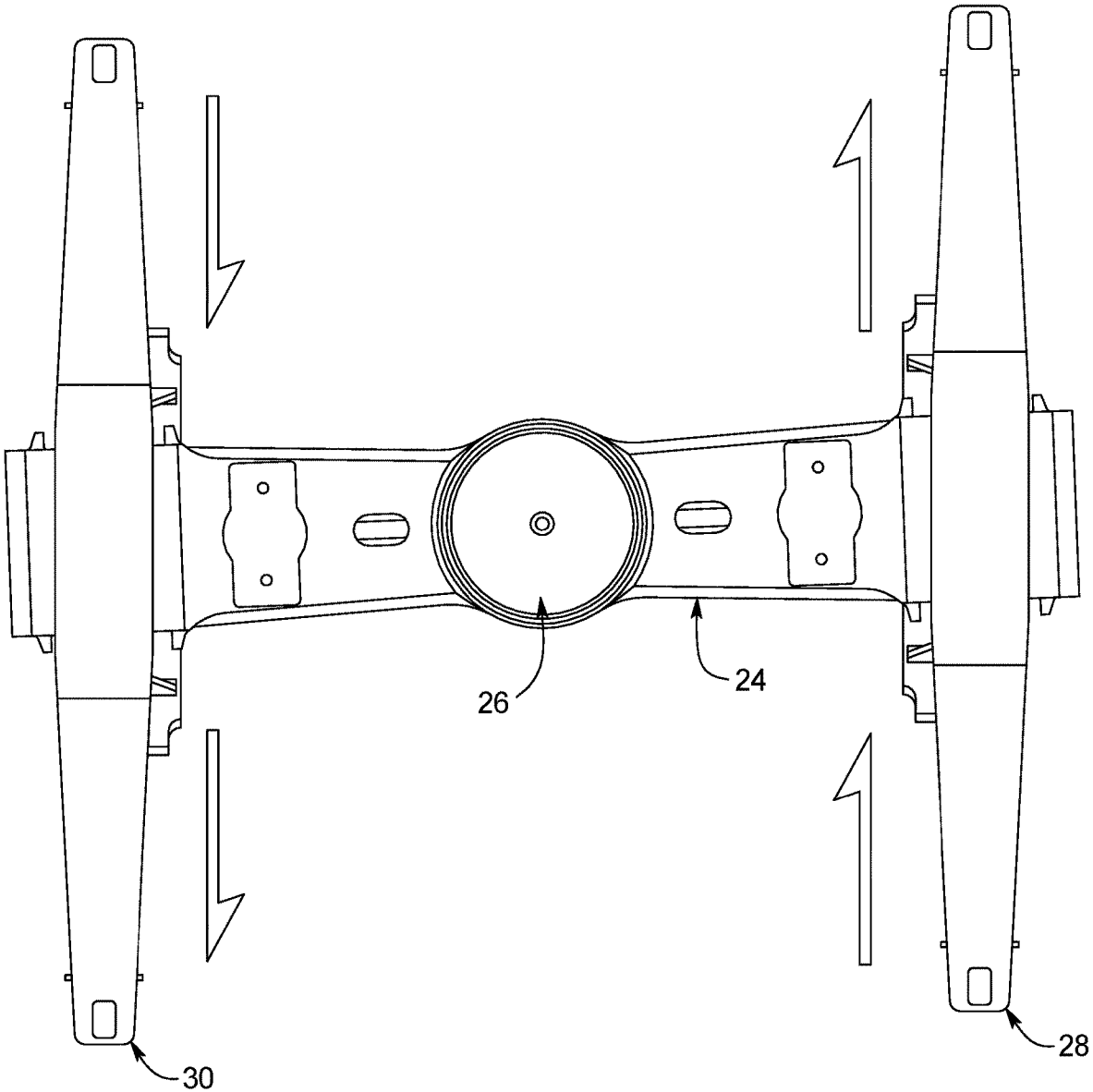
FIG. 2 PRIOR ART
FIG. 2 is a top view of a bolster and two side frames of a conventional freight railroad car truck, and illustrating the bolster in a warped condition relative to the side frames.

Referring now to the drawings and particularly to FIGS. 1 and 2, a conventional railroad car truck that is generally indicated by numeral 20 is shown with respect to freight railroad car 10 configured to roll along railroad tracks or rails 5. The conventional truck 20 includes a bolster 24, a bolster bowl 26 on the bolster 24, a first side frame 28, and a second side frame 30. Generally, the bolster 24 extends transversely to the direction of the railroad tracks or rails 5, and the side frames 28 and 30 extend longitudinally in the same direction as the railroad tracks or rails 5. As indicated by the arrows in FIG. 2, the side frames 28 and 30 are subject to warping where the side frames 28 and 30 remain parallel, but one side frame (such as side frame 28) moves forward with respect to the other side frame (such as side frame 30). When this occurs, the bolster 24 is not square with either of the side frames 28 or 30 and results in the above described problems.

1st Example Embodiment

Referring now to FIGS. 3A, 3B, 4, 5, and 6, one example embodiment of the railroad car truck with warp restraints of the present disclosure is shown and generally indicated by numeral 50. In this illustrated example embodiment of the present disclosure, the railroad car truck 50 includes a bolster 40, a bolster bowl 42 on the bolster 40, a first side frame 60, and a second side frame 80. Generally, the bolster 40 is configured to extend transversely to the direction of the railroad tracks or rails (not shown in FIG. 3A, 3B, 4, 5, or 6), and the side frames 60 and 80 are configured to extend longitudinally in the same direction as the railroad tracks (not shown in FIG. 3A, 3B, 4, 5, or 6). The side frame 60 includes: (a) a longitudinally extending body 62; and (b) two downwardly extending pedestal jaws (including a first pedestal jaw 64 and a second pedestal jaw 66) on opposite sides of the center opening 68 in the body 62 of the side frame 60. The body 62 includes a first side wall, a top wall, a second side wall, and a bottom wall that generally define the center opening 68. The side frame 80 includes: (a) a longitudinally extending body 82; and (b) two downwardly extending pedestal jaws (including a first pedestal jaw 84 and a second pedestal jaw 86) on opposite sides of the center opening 88 in the body 82 of the side frame 80. The body 82 includes a first side wall, a top wall, a second side wall, and a bottom wall that generally define the center opening 88.

In this illustrated example embodiment of the present disclosure, as best shown in FIGS. 3A, 3B, 4, 5, and 6, the railroad car truck with warp restraints 50 includes: (1) a first plurality or set of warp restraints 100 and 200; and (2) a second plurality or set of warp restraints 500 and 600. More specifically, in this illustrated embodiment, (a) warp restraint 100 includes a first bearing 110 integrally formed at and extending from a first portion of the bolster 40 and a second opposing bearing 140 integrally formed at and extending from the first side frame 60; (b) warp restraint 200 includes a first bearing 210 integrally formed at and extending from the first portion of the bolster 40 and a second opposing bearing 240 integrally formed at and extending from the first side frame 60; (c) warp restraint 500 includes a first bearing 510 integrally formed at and extending from a second portion of the bolster 40 and a second opposing bearing 540 integrally formed at and extending from the second side frame 80; and (d) warp restraint 600 includes a first bearing 610 integrally formed at and extending from the second end portion of the bolster 40 and a second opposing bearing 640 integrally formed at and extending from the second side frame 80. Thus, (a) bearings 110, 210, 510, and 610 are integrally formed at and extend from the respective portions of the bolster 40 (on the inward sides of the side frames 60 and 80); (b) bearings 140 and 240 are integrally formed at and extend from the inward side of the first side frame 60; and (c) bearings 540 and 640 are integrally formed at and extend from the inward side of the second side frame 80.

It should be appreciated that each of the warp restraints 100, 200, 500, and 600 in various embodiments are identical or substantially identical (except for their positioning and arrangement of their connectors to, connections with, or formations with the side frames and the bolster). Therefore, warp restraints 100 and 200 are primarily discussed in further detail below as examples of the warp restraints of this example embodiment. However, it should be appreciated that the warp restraints of the present disclosure do not need to be identical or substantially identical and can vary based on the respective positions and connections to or formations with the side frames and the bolster. For example, the two bearings of any set of warp restraints may be different.

Example warp restraint 100 includes a first bearing 110 integrally formed with a first portion of the bolster 40 and a second opposing bearing 140 integrally formed with the first side frame 60. It should be appreciated that the first bearing 110 may be connected to the bolster 40 by one or more suitable first bearing connecters (not shown). It should also be appreciated that the second bearing 140 may be connected to the bolster 40 by one or more suitable second bearing connecters (not shown).

Figure 5:
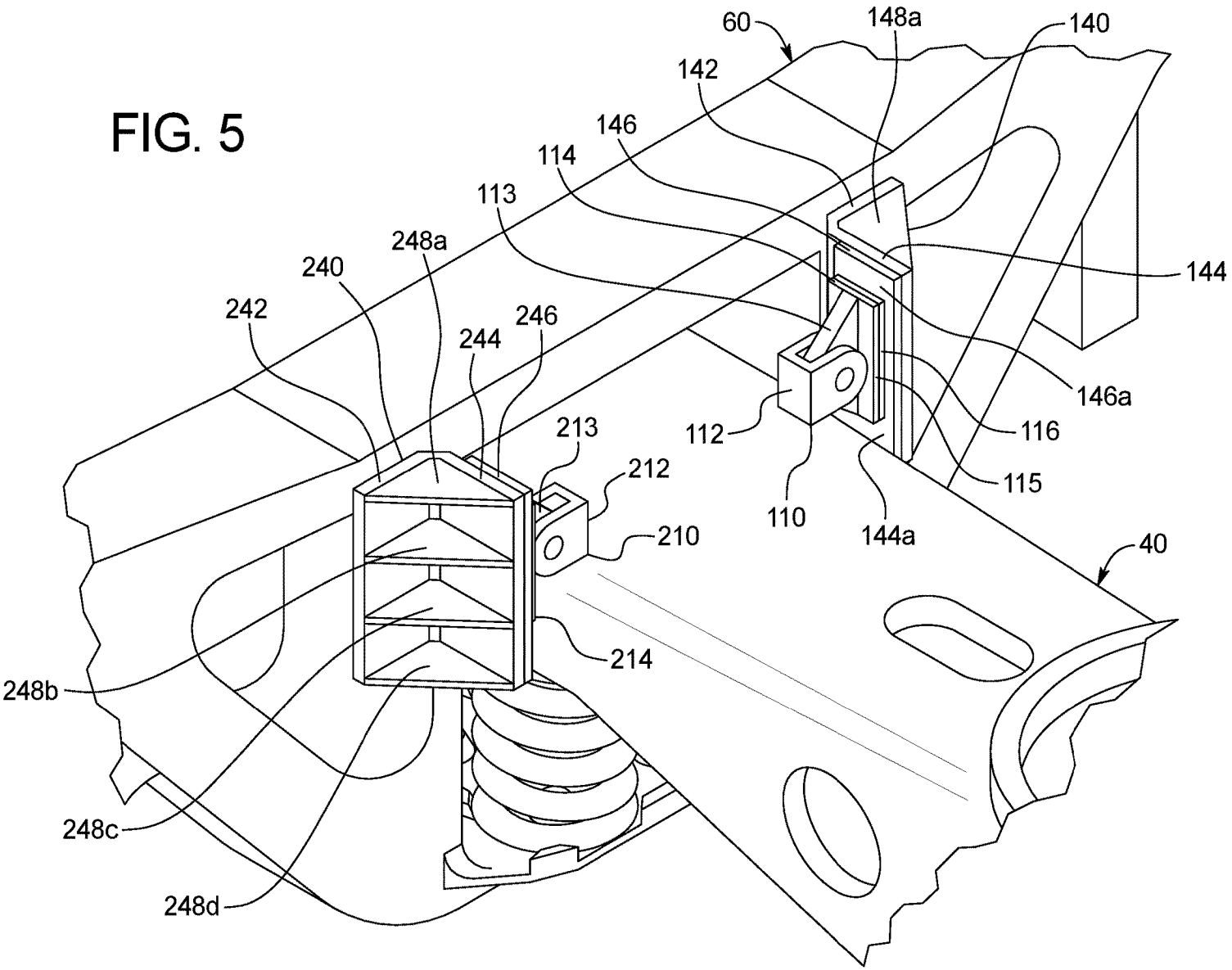
FIG. 5 is an enlarged fragmentary perspective view of the bolster, one of the side frames, and two warp restraints of the freight railroad car truck of FIG. 3A, and illustrating the bearings of the warp restraints integrally cast with the bolster, and the bearings of the warp restraints integrally cast with the side frame.
Figure 6:
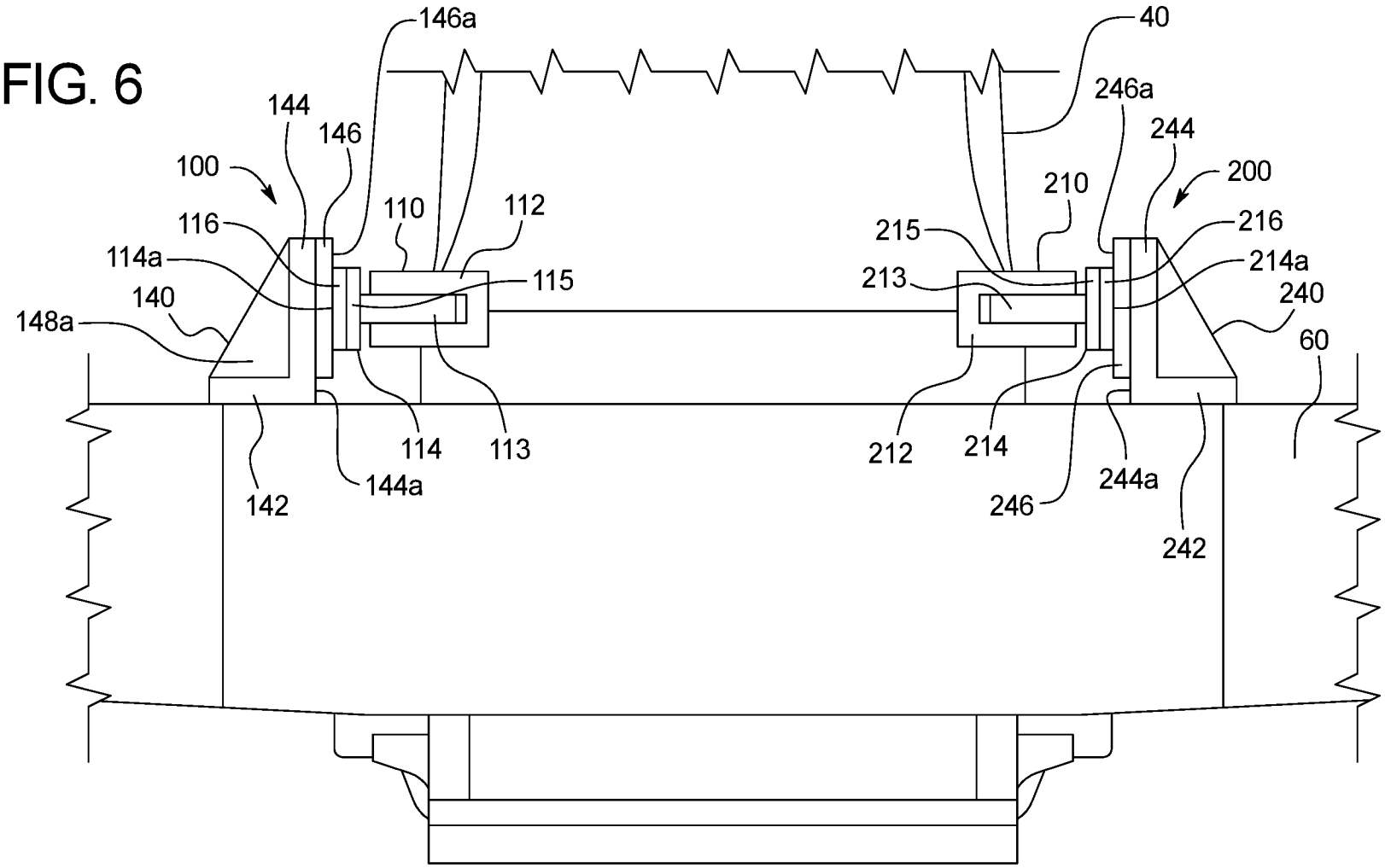
FIG. 6 is an enlarged fragmentary top view of one end portion of the bolster, a first one of the side frames, and a first one of the two sets of warp restraints of the freight railroad car truck of FIG. 3A.

As best shown in FIGS. 5 and 6, the first bearing 110 includes: (a) a substantially horizontally extending mounting bracket 112 integrally connected to the bolster 40; (b) a movable engagement pad 114 pivotally connected to the mounting bracket 112; (c) a connection arm 113 extending transversely from the back of the engagement pad 114; and (d) a pivot pin (not shown). The movable engagement pad 114 is pivotally connected to the mounting bracket 112 by the connection arm 113 and by the pivot pin (not shown). The engagement pad 114 includes an inner substantially vertically extending engagement surface 114*a*. In this illustrated embodiment, the engagement pad 114 includes a mounting base 115 and a wear member 116 removably connected to the mounting base 115 by one or more suitable fasteners (not shown).

In this illustrated embodiment, the engagement pad 114 is pivotal about a horizontally or substantially horizontally extending axis (not shown) extending through the pivot pin (not shown). It should be appreciated that in various alternative embodiments of the present disclosure, the mounting bracket 112, the engagement pad 114, the connection arm 113, and the pivot pin can be configured such that the engagement pad 114 is pivotal about a differently extending axis.

In this illustrated embodiment, the engagement pad 114 and/or the engagement surface 114*a* each extend in the same direction (such as parallel) to the centerline, center plane, or center axis of the bolster (that in turn extends transversely relative to straight tracks). It should be appreciated that in various alternative embodiments of the present disclosure, the engagement pad 114 and/or the engagement surface 114*a* is: (a) angled outwardly; (b) angled inwardly; (c) initially angled upwardly; (d) initially angled downwardly; (e) initially angled outwardly and upwardly; (f) initially angled outwardly and downwardly; (g) initially angled inwardly and upwardly; or (h) initially angled inwardly and downwardly, to assist in providing the desired forces on the bolster 40 and the side frames 60 and 80 to reduce, inhibit, and/or minimize warping of the side frames 60 and 80 relative to the bolster 40. Thus, in various embodiments, the angle between: (a) a plane extending through the engagement pad 114 and/or along the engagement surface 114*a* in its initial position; relative to: (b) a plane extending through the side frame 60 may be right (as shown in FIGS. 5 and 6), may be obtuse, or may be acute. An example of this is further illustrated in the alternative example embodiment of FIG. 7 discussed below.

As also best shown in FIGS. 5 and 6, the second bearing 140 includes: (a) a substantially vertically extending side frame mounting wall 142 integrally connected to the inner surface of the side frame 60; (b) a substantially vertically extending engagement wall 144 integrally connected to the side frame mounting wall 142 and extending inwardly transversely from the side frame mounting wall 142; (c) a substantially vertically extending engagement pad 146 integrally connected to the engagement wall 144; and (d) a plurality of substantially horizontally extending braces (such as brace 148*a*) each integrally connected to the side frame mounting wall 142 and integrally connected to the engagement wall 142. The engagement wall 144 includes an inner substantially vertically extending engagement side 144*a*. The engagement pad 146 includes an inner substantially vertically extending engagement surface 146*a*.

In this illustrated embodiment, the engagement wall 144, the engagement side 144*a*, the engagement pad 146, and the engagement surface 146*a* also extend in the same direction (such as parallel) to the centerline, center plane, or center axis of the bolster (that in turn extends transversely relative to straight tracks). It should be appreciated that in various alternative embodiments of the present disclosure, the engagement wall 144, the engagement side 144*a*, the engagement pad 146, and/or the engagement surface 146*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 40 and the side frames 60 and 80 to reduce, inhibit, and/or minimize warping of the side frames 60 and 80 relative to the bolster 40 as further described below. Thus, in various embodiments, the angle between: (a) a plane extending through the engagement wall 144, along the engagement side 144*a*, through the engagement pad 146, or through the engagement surface 146*a*; relative to: (b) a plane extending through the side frame 60 may be right (as shown in FIGS. 5 and 6), may be obtuse, or may be acute. An example of this is further illustrated in the alternative example embodiment of FIG. 7 discussed below.

The first bearing 110 and the second opposing bearing 140 are thus configured to engage each other (as generally shown in FIGS. 3A, 3B, 5, and 6). More specifically, the engagement surface 114*a* of the engagement pad 114 is configured to engage the engagement surface 146*a* of the engagement pad 146 (as shown in FIGS. 5 and 6). The configuration of the warp restraint 100, and specifically the configuration of the first bearing 110 and the second opposing bearing 140, bias or co-act to provide biasing forces on the bolster 40 and the side frame 60 toward the normal square position to reduce, inhibit, or minimize warping as further described below.

Likewise, example warp restraint 200 includes a first bearing 210 integrally formed with a first portion of the bolster 40 and a second opposing bearing 240 integrally formed with the first side frame 60. It should be appreciated that the first bearing 210 may be connected to the bolster 40 by one or more suitable first bearing connecters (not shown). It should also be appreciated that the second bearing 240 may be connected to the bolster 40 by one or more suitable second bearing connecters (not shown).

More specifically, as best shown in FIGS. 5 and 6, the first bearing 210 includes: (a) a substantially horizontally extending mounting bracket 212 integrally connected to the bolster 40; (b) a movable engagement pad 214 pivotally connected to the mounting bracket 212; (c) a connection arm 213 extending transversely from the back of the engagement pad 214; and (d) a pivot pin (not shown). The movable engagement pad 214 is pivotally connected to the mounting bracket 212 by the connection arm 213 and by the pivot pin (not shown). The engagement pad 214 includes an inner substantially vertically extending engagement surface 214*a*. In this illustrated embodiment, the engagement pad 214 includes a mounting base 215 and a wear member 216 removably connected to the mounting base 215 by one or more suitable fasteners (not shown).

In this illustrated embodiment, the engagement pad 214 is pivotal about a horizontally or substantially horizontally extending axis (not shown) extending through the pivot pin (not shown). It should be appreciated that in various alternative embodiments of the present disclosure, the mounting bracket 212, the engagement pad 214, the connection arm 213, and the pivot pin can be configured such that the engagement pad 214 pivots about a differently extending axis.

In this illustrated embodiment, the engagement pad 214 and/or the engagement surface 214*a* extends in the same direction (such as parallel) to the centerline, center plane, or center axis of the bolster (that in turn extends transversely relative to straight tracks). It should be appreciated that in various alternative embodiments of the present disclosure, the engagement pad 214 and/or the engagement surface 214*a* is: (a) angled outwardly; (b) angled inwardly; (c) initially angled upwardly; (d) initially angled downwardly; (e) initially angled outwardly and upwardly; (f) initially angled outwardly and downwardly; (g) initially angled inwardly and upwardly; or (h) initially angled inwardly and downwardly, to assist in providing the desired forces on the bolster 40 and the side frames 60 and 80 to reduce, inhibit, and/or minimize warping of the side frames 60 and 80 relative to the bolster 40. Thus, in various embodiments, the angle between: (a) a plane extending through the engagement pad 214 or along the engagement surface 214*a* in its initial position; relative to: (b) a plane extending through the side frame 60 may be right (as shown in FIGS. 5 and 6), may be obtuse, or may be acute. An example of this is further illustrated in the alternative example embodiment of FIG. 7 discussed below.

As also best shown in FIGS. 5 and 6, the second bearing 240 includes: (a) a substantially vertically extending side frame mounting wall 242 integrally connected to the inner surface of the side frame 60; (b) a substantially vertically extending engagement wall 244 integrally connected to the side frame mounting wall 242 and extending inwardly transversely from the side frame mounting wall 242; (c) a substantially vertically extending engagement pad 246 integrally connected to the engagement wall 244; and (d) a plurality of substantially horizontally extending braces (such as brace 248*a*, brace 248*b*, brace 248*c*, and brace 248*d*) each integrally connected to the side frame mounting wall 242 and integrally connected to the engagement wall 242.

The engagement wall 244 includes an inner substantially vertically extending engagement side 244*a* (that extends substantially parallel with the center line, center plane, or center axis of the bolster). The engagement pad 246 includes an inner substantially vertically extending engagement surface 246*a* (that extends substantially parallel with the crosswise axis of the bolster). It should be appreciated that in various alternative embodiments of the present disclosure, the engagement wall 244, the engagement side 244*a*, the engagement pad 246, and/or the engagement surface 246*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 40 and the side frames 60 and 80 to reduce, inhibit, and/or minimize warping of the side frames 60 and 80 relative to the bolster 40 as further described below. Thus, in various embodiments, the angle between: (a) a plane extending through the engagement wall 244, along the engagement side 244*a*, through the engagement pad 246, or through the engagement surface 246*a*; relative to: (b) a plane extending through the side frame 60 may be right (as shown in FIGS. 5 and 6), may be obtuse, or may be acute. An example of this is further illustrated in the alternative example embodiment of FIG. 7 discussed below.

The first bearing 210 and the second opposing bearing 240 are thus configured to engage each other (as generally shown in FIGS. 3A, 3B, 5, and 6). More specifically, the engagement surface 214*a* of the engagement pad 214 is configured to engage the engagement surface 246*a* of the engagement pad 246 (as more specifically shown in FIGS. 5 and 6). The configuration of the warp restraint 200, and specifically the configuration of the first bearing 210 and the second opposing bearing 240, bias or co-act to provide biasing forces on the bolster 40 and the side frame 60 toward the normal square position to reduce, inhibit, or minimize warping as further described below.

In this example embodiment, the removable wear members 116 and 216 of the respective engagement pads 114 and 214 of the bearings can be made from a relatively hard plastic material with self-lubricating characteristics such as from an acetal resin such as a DELRIN material. DELRIN is a registered trademark of E. I. du Pont de Nemours.

In this example embodiment, engagement pads 146 and 246 are made from a suitable steel for strength.

It should be appreciated that in various embodiments, the removable wear members 116 and 216 are respectively removeably attached to the mounting bases 115 and 215 to facilitate replacement of such wear member as they wear out.

In various such embodiments, before replacement but after the wear members are worn to a certain degree, suitable shims (not shown) may be employed to maintain engagement between the respective sets of first and second bearings.

In various other such embodiments, one or more of the first and second bearings can include one or more biasing members (not shown) to maintain engagement between the respective sets of first and second bearings.

In various other such embodiments, one or more adjustment devices (not shown) can be used with the bearing members to maintain engagement between the respective sets of first and second bearings. In various embodiments, the adjustment devices include opposing threaded members that are rotatably adjustable to maintain engagement between the respective sets of first and second bearings.

As mentioned above, warp restraints 500 and 600 of the present disclosure are identical to warp restraints 100 and 200 except that warp restraints 500 and 600 are attached to the second side frame 80 and the second portion of the bolster 40. Thus, these warp restraints 500 and 600 are not described in further detail.

It should be appreciated that bearing 110 (and specifically the mounting bracket 112 thereof), bearing 210 (and specifically the mounting bracket 212 thereof), bearing 510 (and specifically the mounting bracket thereof), and bearing 610 (and specifically the mounting bracket thereof) can be integrally cast with the bolster 40 in various embodiments of the present disclosure. Likewise, it should be appreciated that bearing 140 (and specifically the mounting wall 142 thereof) and bearing 240 (and specifically the mounting wall 242 thereof) can be integrally cast with the side frame 60 in various embodiments of the present disclosure. Likewise, it should be appreciated that bearing 540 (and specifically the mounting wall thereof) and bearing 640 (and specifically the mounting wall thereof) can be integrally cast with the side frame 80 in various embodiments of the present disclosure.

Figure 3A:
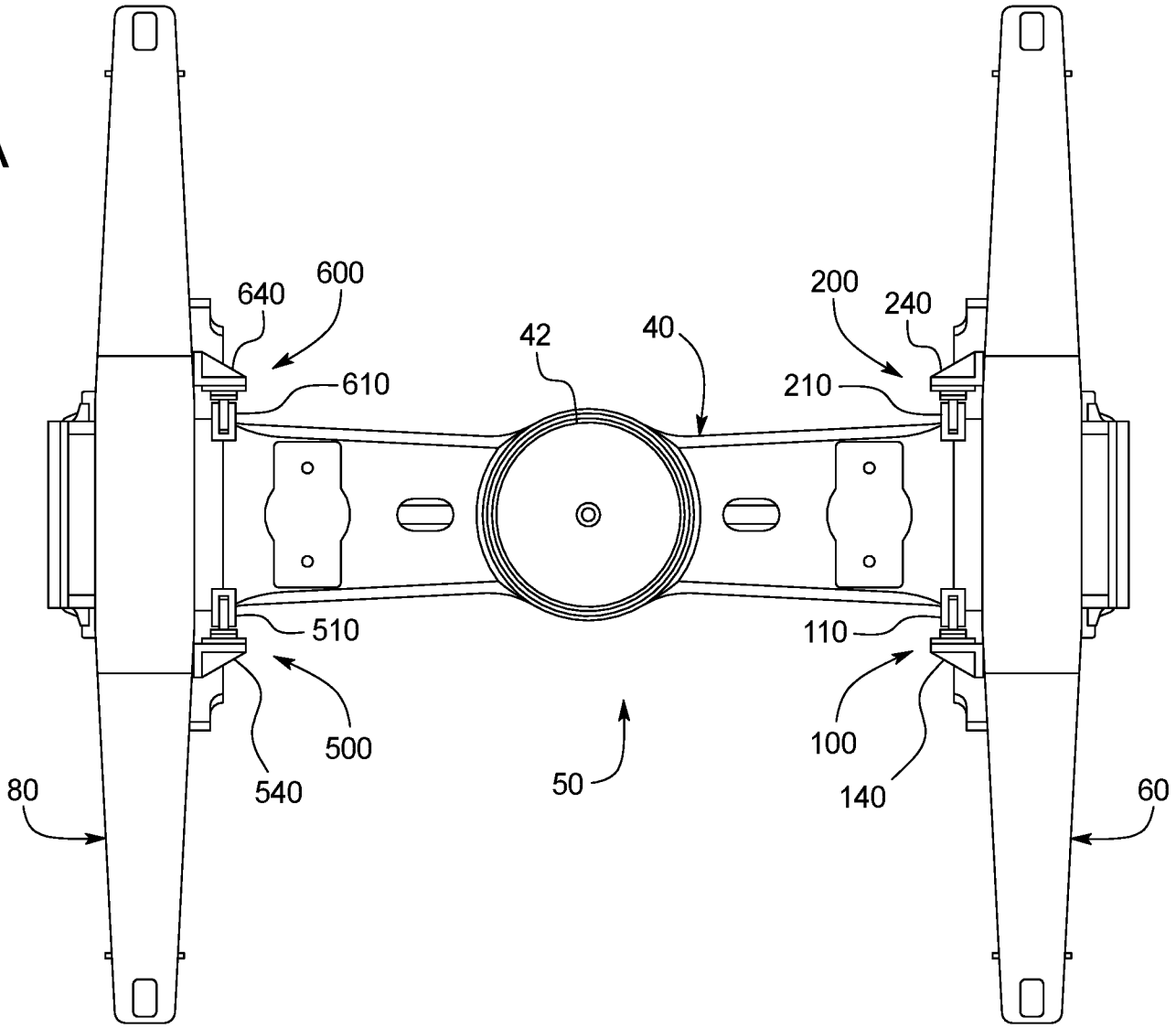
FIG. 3A is a top view of a bolster, two side frames, and four warp restraints of one example embodiment of the freight railroad car truck of the present disclosure, and illustrating the bolster in a square condition relative to the side frames.
Figure 3B:
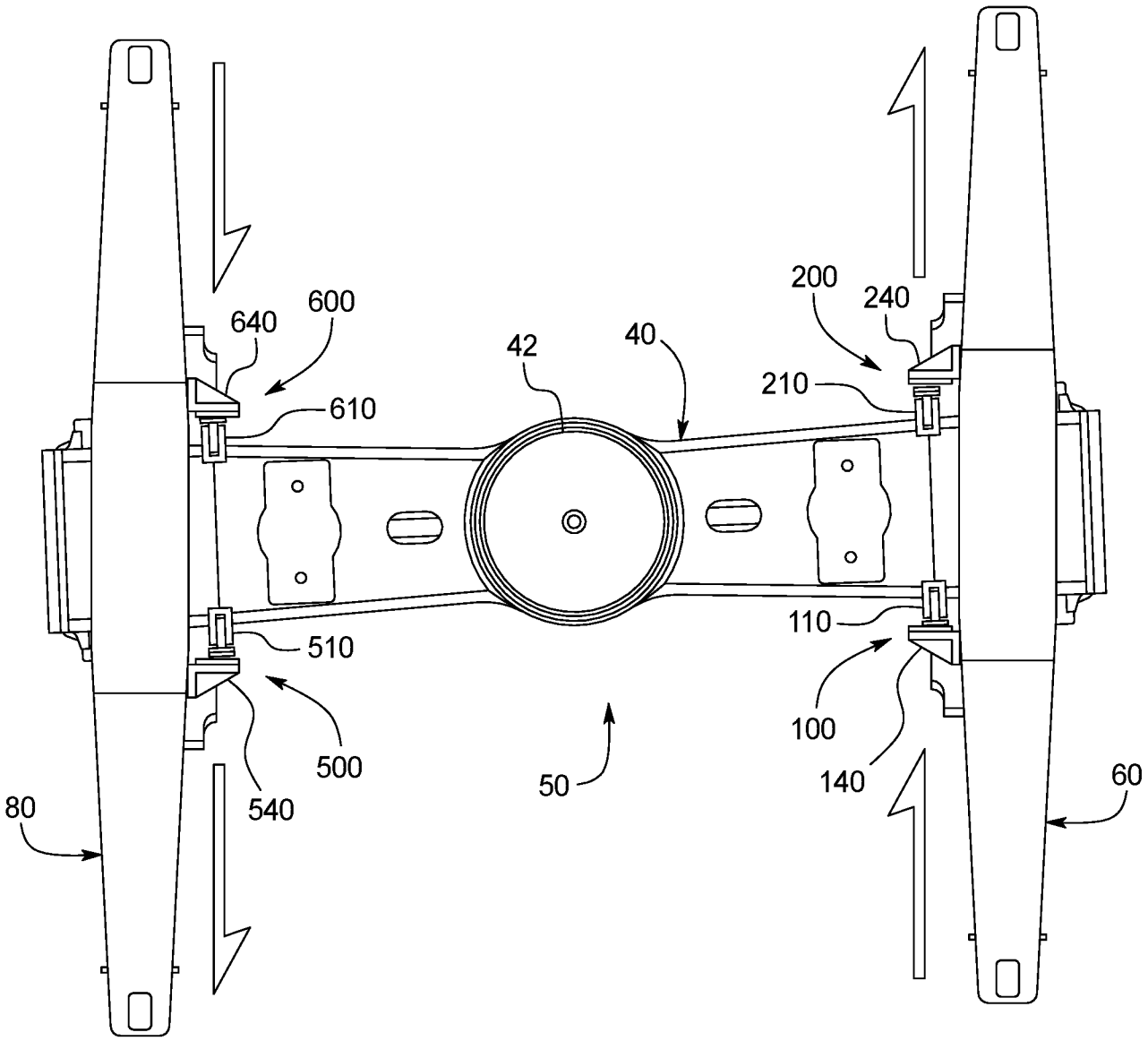
FIG. 3B is a top view of a bolster, two side frames, and four warp restraints of the example embodiment of the freight railroad car truck of FIG. 3A, wherein the truck is in a warped position, and wherein certain of the warp restraints are applying biasing forces to urge the truck back to a square position.
Figure 4:
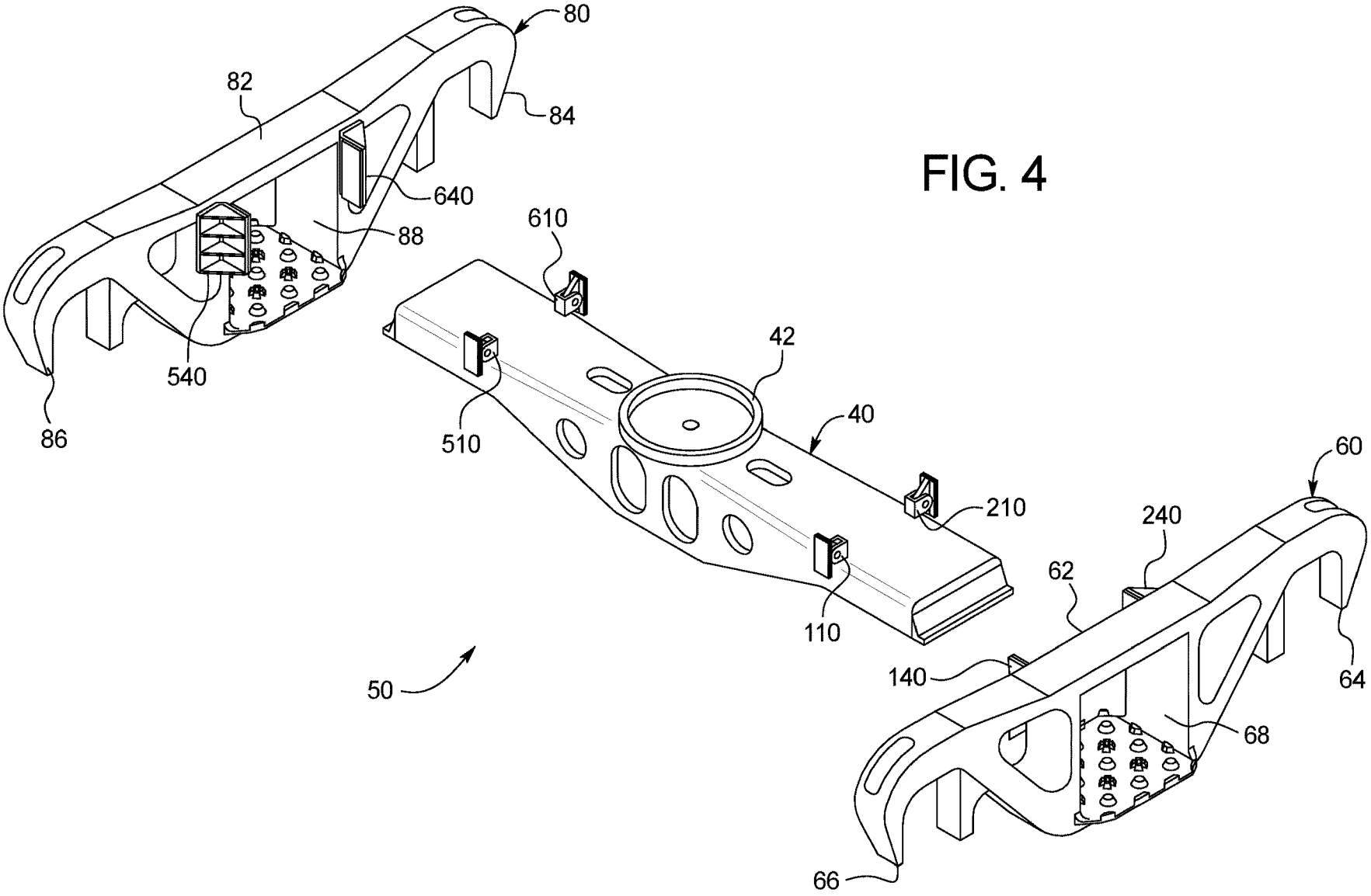
FIG. 4 is an exploded perspective view of the bolster, two side frames, and four warp restraints of the freight railroad car truck of FIG. 3A, and illustrating the bearings of the warp restraints integrally cast with the bolster, and the bearings of the warp restraints integrally cast with the respective side frames.

When warping occurs as generally shown in FIGS. 2 and 3A, the bolster 40 is not square with either of the side frames 60 or 80. Warping is somewhat of a particular combination of forces wherein each end of the bolster wants to twist inside of the aperture of the respective side frame. The warp restraints 100, 200, 500, and 600 of the present disclosure can: (1) independently apply counter biasing forces to the bolster 40; and (2) apply counter biasing forces to the bolster 40 in groups, wherein such forces act independently or in combination or co-act to cause the bolster 40 to return to its normal position and thus reduce, inhibit, and/or minimize warping. Specifically, in certain embodiments, depending upon the specific positioning, arrangements, and configurations of the respective engagement pads (such as engagement pads 114 and 146 and engagement pads 214 and 246), the engagement pads will exert opposing forces on the opposing bearings (such as opposing bearing 110 and 140 and opposing bearing 210 and 240) to move away from such positions and back toward their normal positions.

For example, if the warping shown on the right end portion of the bolster in FIG. 2 or FIG. 3A begins to occur or occurs to the truck of the present disclosure, the warps restraints 100, 200, 500, and 600 can act individually and in groups to apply biasing forces to the bolster 40 to cause the bolster 40 to return to its normal or square position and thus act or co-act to reduce, inhibit, and/or minimize warping. Likewise, if the warping is reversed, the warp restraints 100, 200, 500, and 600 can act individually and in groups to apply biasing forces to the bolster 40 to cause the bolster 40 to return to its normal or square position and thus co-act to prevent, reduce, inhibit, and/or minimize warping.

The four warp restraints 100, 200, 500, and 600 of the present disclosure thus act independently and/or co-act in groups to bias the bolster toward the square positions relative to the side frames 60 and 80 such that the centerline or center plane of the bolster (that extends transversely relative to straight tracks) is perpendicular or substantially perpendicular to the centerlines or center planes of the respective side frames 60 and 80 (that extend longitudinally relative to straight tracks).

$2^{nd}$ Example Embodiment

Figure 7:
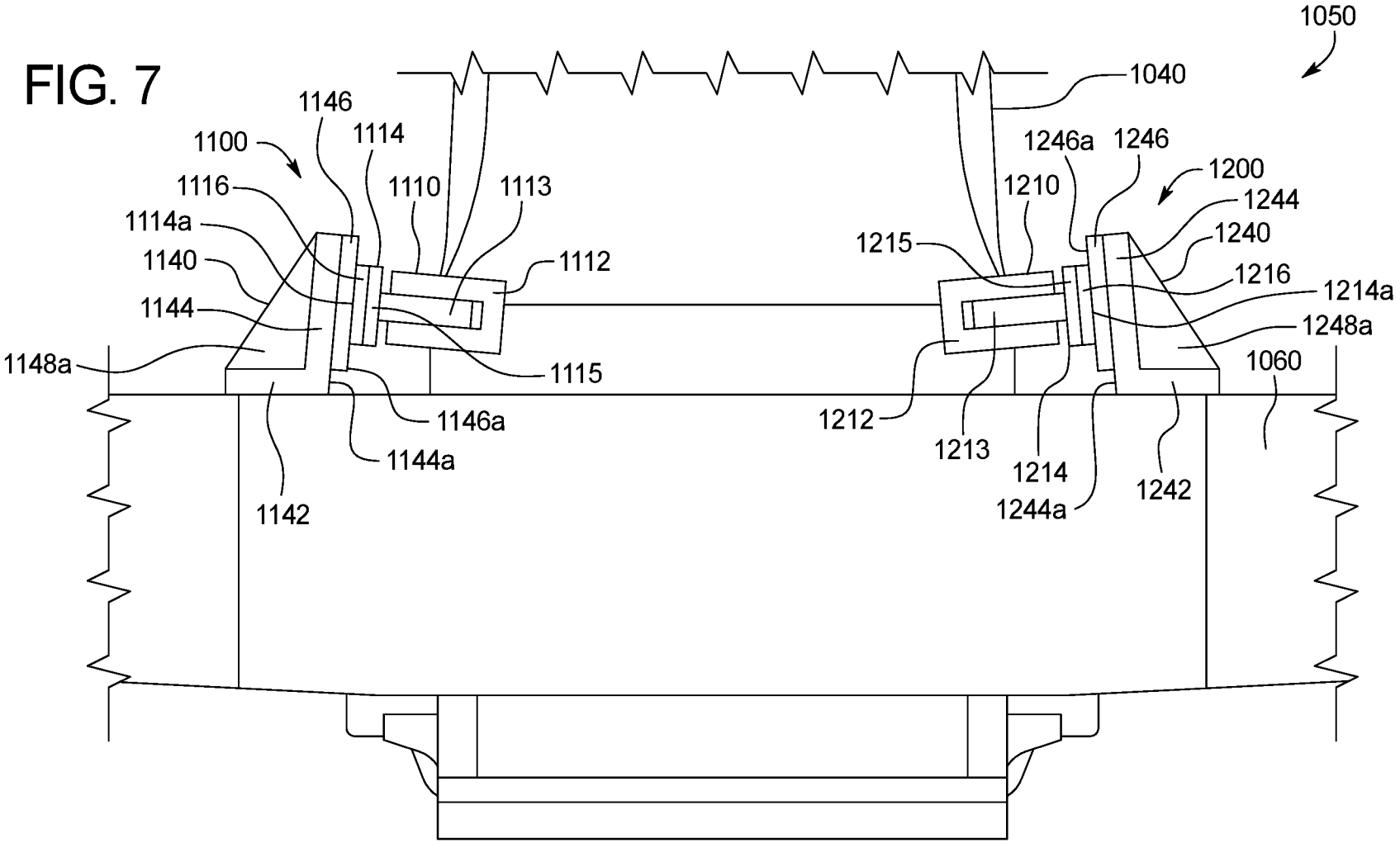
FIG. 7 is an enlarged fragmentary top view of one end portion of the bolster, a first one of the side frames, and a first one of the two sets of warp restraints of freight railroad car truck of an alternative embodiment of the present disclosure.

Referring now to FIG. 7, another embodiment of the railroad car truck with warp restraints of the present disclosure is shown and generally indicated by numeral 1050. This illustrated example embodiment of the present disclosure is similar to the embodiment of FIGS. 3A, 3B, 4, 5, and 6, except that: (1) the first plurality or set of warp restraints (not shown) 1100 and 1200 are angled relative to the first side frame 1060; and (2) the second plurality or set of warp restraints (not shown) are angled relative to the second side frame (not shown in FIG. 7). More specifically, in this illustrated embodiment, (a) warp restraint 1100 includes a first angled bearing 1110 integrally formed at and extending from a first portion of the bolster 1040 and a second angled opposing bearing 1140 integrally formed at and extending from the first side frame 1060; and (b) warp restraint 1200 includes a first angled bearing 1210 integrally formed at and extending from the first portion of the bolster 1040 and a second angle opposing bearing 1240 integrally formed at and extending from the first side frame 60.

It should be appreciated that each of the warp restraints in this illustrated example embodiment are identical or substantially identical (except for positioning and arrangement of their connectors to, connections with, or formations with the side frames and the bolster). However, it should be appreciated that the warp restraints of the present disclosure do not need to be identical or substantially identical and can vary based on the respective positions and connections to or formations with the side frames and the bolster. For example, the two bearings of any set of warp restraints may be different.

More specifically, example warp restraint 1100 includes a first bearing 1110 integrally formed with a first portion of the bolster 1040 and a second opposing bearing 1140 integrally formed with the first side frame 1060. It should be appreciated that the first bearing 1110 may be connected to the bolster 1040 by one or more suitable first bearing connecters (not shown). It should also be appreciated that the second bearing 1140 may be connected to the side frame 1060 by one or more suitable second bearing connecters (not shown).

As shown in FIG. 7, the first bearing 1110 includes: (a) a substantially horizontally extending mounting bracket 1112 integrally connected to the bolster 1040; (b) a movable engagement pad 1114 pivotally connected to the mounting bracket 1112; (c) a connection arm 1113 extending transversely from the back of the engagement pad 1114; and (d) a pivot pin (not shown). The movable engagement pad 1114 is pivotally connected to the mounting bracket 1112 by the connection arm 1113 and by the pivot pin (not shown). The engagement pad 1114 includes an inner substantially vertically extending engagement surface 1114*a*. In this illustrated embodiment, the engagement pad 1114 includes a mounting base 1115 and a wear member 1116 removably connected to the mounting base 1115 by one or more suitable fasteners (not shown).

In this illustrated embodiment, the engagement pad 1114 is pivotal about a horizontally or substantially horizontally extending axis (not shown) extending through the pivot pin (not shown). It should be appreciated that in various alternative embodiments of the present disclosure, the mounting bracket 1112, the engagement pad 1114, the connection arm 1113, and the pivot pin can be configured such that the engagement pad 1114 is pivotal about a differently extending axis.

In this illustrated embodiment, the engagement pad 1114 and/or the engagement surface 1114*a* extend at an angle to the centerline, center plane, or center axis of the bolster (that in turn extends transversely relative to straight tracks). In other words, in this embodiment, the engagement pad 1114 and/or the engagement surface 1114*a* is angled outwardly to provide the desired forces on the bolster 1040 and the side frames 1060 and 1080 to reduce, inhibit, and/or minimize warping of the side frames relative to the bolster. Thus, in this embodiment, the angle between: (a) a plane extending through the engagement pad 1114 or along the engagement surface 1114*a*; relative to: (b) a plane extending through the side frame 1060 is obtuse.

As also shown in FIG. 7, the second bearing 1140 includes: (a) a substantially vertically extending side frame mounting wall 1142 integrally connected to the inner surface of the side frame 1060; (b) a substantially vertically extending engagement wall 1144 integrally connected to the side frame mounting wall 1142 and extending inwardly transversely from the side frame mounting wall 1142; (c) a substantially vertically extending engagement pad 1146 integrally connected to the engagement wall 1144; and (d) a plurality of substantially horizontally extending braces (such as brace 1148*a*) each integrally connected to the side frame mounting wall 1142 and integrally connected to the engagement wall 1142. The engagement wall 1144 includes an inner substantially vertically extending engagement side 1144*a*. The engagement pad 1146 includes an inner substantially vertically extending engagement surface 1146*a* (that extends transversely to the crosswise axis of the bolster 1040).

In this illustrated embodiment, the engagement wall 1144, the engagement side 1144*a*, the engagement pad 1146, and the engagement surface 1146*a* extend at an angle to the centerline, center plane, or center axis of the bolster (that in turn extends transversely relative to straight tracks). In other words, in this example embodiment, the engagement wall 1144, the engagement side 1144*a*, the engagement pad 1146, and/or the engagement surface 1146*a* are angled to assist in providing the desired forces on the bolster 1040 and the side frames (such as side frame 1060) to reduce, inhibit, and/or minimize warping of the side frames relative to the bolster 1040 as further described below. Thus, in various embodiments, the angle between: (a) a plane extending through the engagement wall 1144, along the engagement side 1144*a*, through the engagement pad 1146, or through the engagement surface 1146*a*; relative to: (b) a plane extending through the side frame 1060 is acute.

The first bearing 1110 and the second opposing bearing 1140 are thus configured to engage each other (as generally shown in FIG. 7). More specifically, the engagement surface

1114*a* of the engagement pad 1114 is configured to engage the engagement surface 1146*a* of the engagement pad 1146. The configuration of the warp restraint 100, and specifically the configuration of the first bearing 1110 and the second opposing bearing 1140, bias or co-act to provide biasing forces on the bolster 1040 and the side frame 1060 toward the normal square position to reduce, inhibit, and/or minimize warping.

Likewise, example warp restraint 1200 includes a first angled bearing 1210 integrally formed with a first portion of the bolster 1040 and a second opposing angled bearing 1240 integrally formed with the first side frame 1060. It should be appreciated that the first bearing 1210 may be connected to the bolster 1040 by one or more suitable first bearing connecters (not shown). It should also be appreciated that the second bearing 1240 may be connected to the bolster 1040 by one or more suitable second bearing connecters (not shown).

More specifically, as shown in FIG. 7, the first bearing 1210 includes: (a) a substantially horizontally extending mounting bracket 1212 integrally connected to the bolster 1040; (b) a movable engagement pad 1214 pivotally connected to the mounting bracket 1212; (c) a connection arm 1213 extending transversely from the back of the engagement pad 1214; and (d) a pivot pin (not shown). The movable engagement pad 1214 is pivotally connected to the mounting bracket 1212 by the connection arm 1213 and by the pivot pin (not shown). The engagement pad 1214 includes an inner substantially vertically extending engagement surface 1214*a*. In this illustrated embodiment, the engagement pad 1214 includes a mounting base 1215 and a wear member 1216 removably connected to the mounting base 1215 by one or more suitable fasteners (not shown).

In this illustrated embodiment, the engagement pad 1214 is pivotal about a horizontally or substantially horizontally extending axis (not shown) extending through the pivot pin (not shown). It should be appreciated that in various alternative embodiments of the present disclosure, the mounting bracket 1212, the engagement pad 1214, the connection arm 1213, and the pivot pin can be configured such that the engagement pad 1214 pivots about a differently extending axis.

In this illustrated embodiment, the engagement pad 1214 and/or the engagement surface 1214*a* extend at an outward angle to provide the desired forces on the bolster 1040 and the side frames (such as side frame 1060) to reduce, inhibit, and/or minimize warping of the side frames relative to the bolster 1040. Thus, in various embodiments, the angle between: (a) a plane extending through the engagement pad 1214 or along the engagement surface 1214*a*; relative to: (b) a plane extending through the side frame 1060 is obtuse.

As also shown in FIG. 7, the second bearing 1240 includes: (a) a substantially vertically extending side frame mounting wall 1242 integrally connected to the inner surface of the side frame 1060; (b) a substantially vertically extending engagement wall 1244 integrally connected to the side frame mounting wall 1242 and extending inwardly transversely from the side frame mounting wall 1242; (c) a substantially vertically extending engagement pad 1246 integrally connected to the engagement wall 1244; and (d) a plurality of substantially horizontally extending braces (such as brace 1248*a*) each integrally connected to the side frame mounting wall 1242 and integrally connected to the engagement wall 1242. The engagement wall 1244 includes an inner substantially vertically extending engagement side 1244*a* (that extends substantially parallel with the crosswise axis of the bolster). The engagement pad 1246 includes an inner substantially vertically extending engagement surface 1246*a* (that extends transversely to the crosswise axis of the bolster 1040).

In this embodiment, the engagement wall 1244, the engagement side 1244*a*, the engagement pad 1246, and/or the engagement surface 1246*a* is angled to assist in providing the desired forces on the bolster and the side frames to reduce, inhibit, and/or minimize warping of the side frames relative to the bolster. Thus, in this embodiment, the angle between: (a) a plane extending through the engagement wall 1244, along the engagement side 1244*a*, through the engagement pad 1246, or through the engagement surface 1246*a*; relative to: (b) a plane extending through the side frame 60 is acute.

The first bearing 1210 and the second opposing bearing 1240 are thus configured to engage each other (as generally shown in FIG. 7). More specifically, the engagement surface 1214*a* of the engagement pad 1214 is configured to engage the engagement surface 1246*a* of the engagement pad 1246. The configuration of the warp restraint 1200, and specifically the configuration of the first bearing 1210 and the second opposing bearing 1240, bias or co-act to provide biasing forces on the bolster 40 and the side frame 60 toward the normal square position to reduce, inhibit, and/or minimize warping.

In these embodiments, the wear members of the engagement pads of the bearings can be made from a relatively hard plastic material with self-lubricating characteristics such as from an acetal resin such as a DELRIN material.

In this example embodiment, engagement pads 1146 and 1246 are made from a suitable steel for strength.

It should be appreciated that in various embodiments, the wear member are respectively removably attached to the mounting bases to facilitate replacement of such wear members as they wear out.

In various such embodiments, before replacement but after the wear members are worn to a certain degree, suitable shims (not shown) may be employed to maintain engagement between the respective sets of first and second bearings.

In various other such embodiments, one or more of the first and second bearings can include one or more biasing members (not shown) to maintain engagement between the respective sets of first and second bearings.

In various other such embodiments, one or more adjustment devices (not shown) can be used with the bearing members to maintain engagement between the respective sets of first and second bearings. In various embodiments, the adjustment devices include opposing threaded members that are rotatably adjustable to maintain engagement between the respective sets of first and second bearings.

It should be appreciated that bearing 1110 (and specifically the mounting bracket 1112 thereof), bearing 1210 (and specifically the mounting bracket 1212 thereof), and the other respective bearings (and specifically the mounting brackets thereof), can be integrally cast with the bolster 40 in various embodiments of the present disclosure. Likewise, it should be appreciated that bearing 1140 (and specifically the mounting wall 1142 thereof) and bearing 1240 (and specifically the mounting wall 1242 thereof) can be integrally cast with the side frame 1060 in various embodiments of the present disclosure. Likewise, it should be appreciated that the other bearings (and specifically the mounting walls thereof) can be integrally cast with the other side frame in various embodiments of the present disclosure.

3rd Example Embodiment

Figure 8:
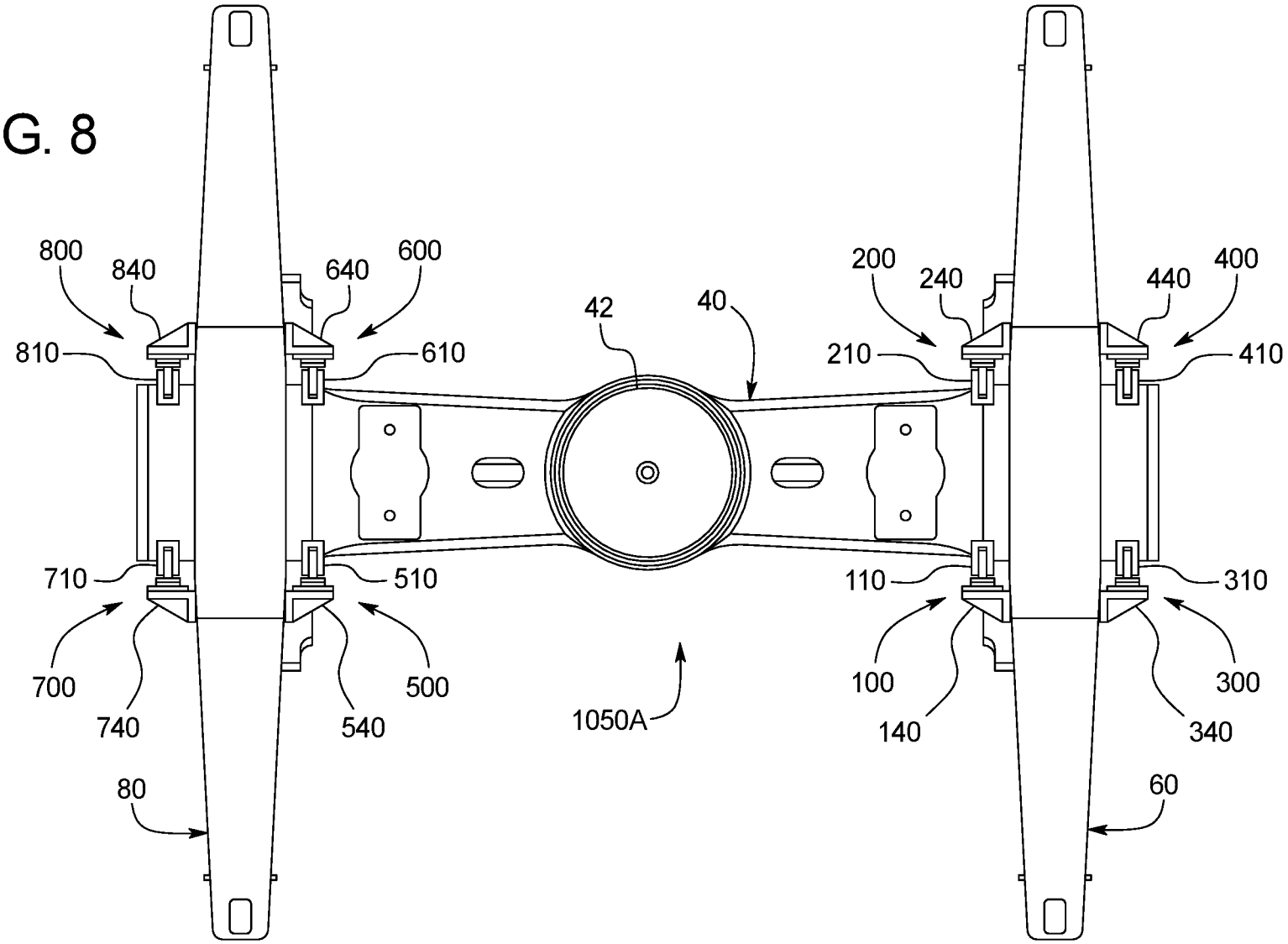
FIG. 8 is an enlarged top view of a bolster, two side frames, and eight warp restraints of another example embodiment of the freight railroad car truck of the present disclosure.
Figure 9:
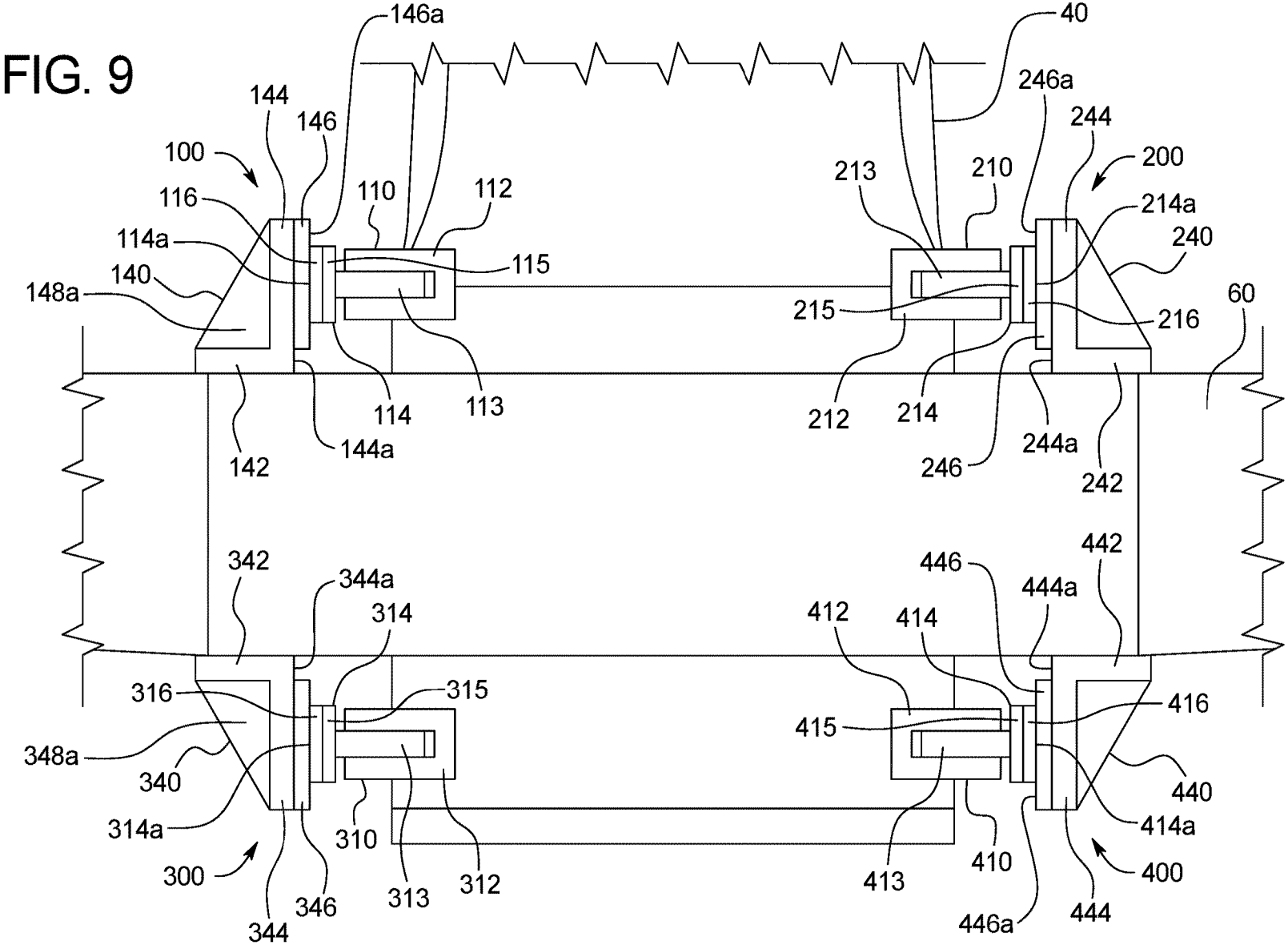
FIG. 9 is an enlarged fragmentary top view of one end portion of the bolster, a first one of the side frames, and four warp restraints of the freight railroad car truck of FIG. 8.
Figure 10A:
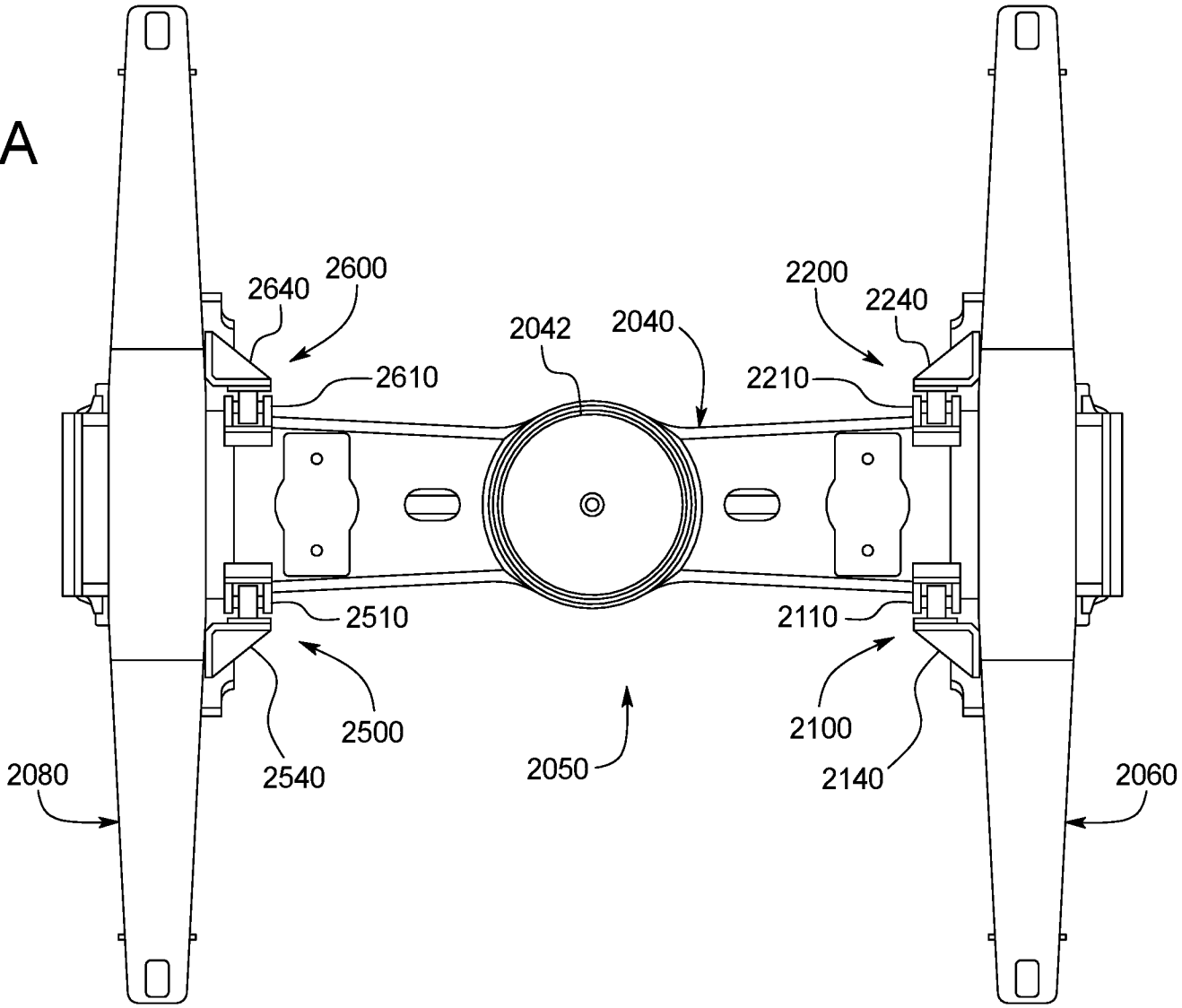
FIG. 10A is a top view of a bolster, two side frames, and four warp restraints of another example embodiment of the freight railroad car truck of the present disclosure, and illustrating the bolster in a square condition relative to the side frames.
Figure 10B:
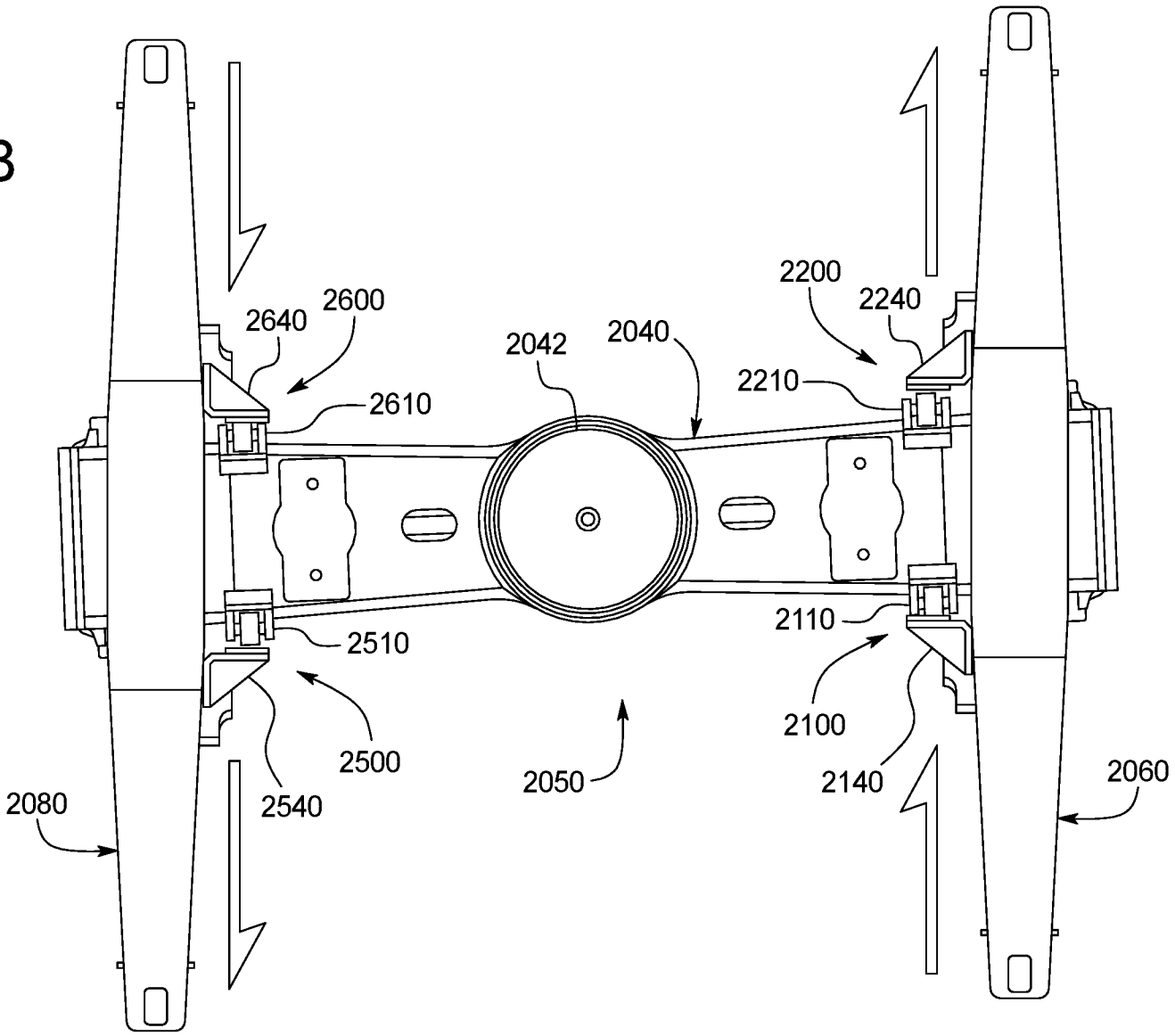
FIG. 10B is a top view of a bolster, two side frames, and four warp restraints of the example embodiment of the freight railroad car truck of FIG. 10A, wherein the truck is in a warped position, and wherein certain of the warp restraints are applying biasing forces to urge the truck back to a square position.

Referring now to FIGS. 8 and 9, another example embodiment of the railroad car truck with warp restraints of the present disclosure is shown and generally indicated by numeral 1050A.

In this illustrated example embodiment of the present disclosure, the railroad car truck with warp restraints 1050A includes: (1) a first plurality or set of warp restraints 100 and 200; (2) a second plurality or set of warp restraints 500 and 600 (on the outer side of the bolster and first side frame); (3) a third plurality or set of warp restraints 300 and 400; and (4) a fourth plurality or set of warp restraints 700 and 800 (on the outer side of the bolster and second side frame). In this illustrated example embodiment of the present disclosure: (1) the first plurality or set of warp restraints 100 and 200 are the same as the warp restraints 100 and 200 of FIGS. 3A to 6; and (2) the second plurality or set of warp restraints 500 and 600 are the same as the warp restraints 500 and 600 of FIGS. 3A to 6. Thus, these warp restraints are indicated by the same numerals as in FIGS. 3A to 6, are not described again in this section, and the above descriptions apply to such warp restraints.

Warp restraints 300, 400, 700, and 800 are similar to warp restraints 100, 200, 500, and 600, and are thus similarly described below.

Warp restraint 300 has a first bearing 310 including: (a) a substantially horizontally extending mounting bracket 312 integrally connected to the bolster 40; (b) a movable engagement pad 314 pivotally connected to the mounting bracket 312; (c) a connection arm 313 extending transversely from the back of the engagement pad 314; and (d) a pivot pin (not shown). The movable engagement pad 314 is pivotally connected to the mounting bracket 312 by the connection arm 313 and by the pivot pin (not shown). The engagement pad 314 includes an inner substantially vertically extending engagement surface 314*a*. In this illustrated embodiment, the engagement pad 314 includes a mounting base 315 and a wear member 316 removably connected to the mounting base 315 by one or more suitable fasteners (not shown).

In this illustrated embodiment, the engagement pad 314 is pivotal about a horizontally or substantially horizontally extending axis (not shown) extending through the pivot pin (not shown). It should be appreciated that in various alternative embodiments of the present disclosure, the mounting bracket 312, the engagement pad 314, the connection arm 313, and the pivot pin can be configured such that the engagement pad 314 is pivotal about a differently extending axis.

In this illustrated embodiment, the engagement pad 314 and/or the engagement surface 314*a* each extend in the same direction (such as parallel) to the centerline, center plane, or center axis of the bolster (that in turn extends transversely relative to straight tracks). It should be appreciated that in various alternative embodiments of the present disclosure, the engagement pad 314 and/or the engagement surface 314*a* is: (a) angled outwardly; (b) angled inwardly; (c) initially angled upwardly; (d) initially angled downwardly; (e) initially angled outwardly and upwardly; (f) initially angled outwardly and downwardly; (g) initially angled inwardly and upwardly; or (h) initially angled inwardly and downwardly, to assist in providing the desired forces on the bolster 40 and the side frames 60 and 80 to reduce, inhibit, or minimize warping of the side frames 60 and 80 relative to the bolster 40. Thus, in various embodiments, the angle between: (a) a plane extending through the engagement pad 314 and/or along the engagement surface 314*a* in its initial position; relative to: (b) a plane extending through the side frame 60 may be right (as shown in FIGS. 8 and 9), may be obtuse, or may be acute.

The second bearing 340 includes: (a) a substantially vertically extending side frame mounting wall 342 integrally connected to the outer surface of the side frame 60; (b) a substantially vertically extending engagement wall 344 integrally connected to the side frame mounting wall 342 and extending inwardly transversely from the side frame mounting wall 342; (c) a substantially vertically extending engagement pad 346 integrally connected to the engagement wall 344; and (d) a plurality of substantially horizontally extending braces (such as brace 348*a*) each integrally connected to the side frame mounting wall 342 and integrally connected to the engagement wall 342. The engagement wall 344 includes an inner substantially vertically extending engagement side 344*a*. The engagement pad 346 includes an inner substantially vertically extending engagement surface 346*a*.

In this illustrated embodiment, the engagement wall 344, the engagement side 344*a*, the engagement pad 346, and the engagement surface 346*a* also extend in the same direction (such as parallel) to the centerline, center plane, or center axis of the bolster (that in turn extends transversely relative to straight tracks). It should be appreciated that in various alternative embodiments of the present disclosure, the engagement wall 344, the engagement side 344*a*, the engagement pad 346, and/or the engagement surface 346*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 40 and the side frames 60 and 80 to reduce, inhibit, and/or minimize warping of the side frames 60 and 80 relative to the bolster 40 as further described below. Thus, in various embodiments, the angle between: (a) a plane extending through the engagement wall 344, along the engagement side 344*a*, through the engagement pad 346, or through the engagement surface 346*a*; relative to: (b) a plane extending through the side frame 60 may be right (as shown in FIGS. 8 and 9), may be obtuse, or may be acute.

The first bearing 310 and the second opposing bearing 340 are thus configured to engage each other (as generally shown in FIGS. 8 and 9). More specifically, the engagement surface 314*a* of the engagement pad 314 is configured to engage the engagement surface 346*a* of the engagement pad 346 (as shown in FIGS. 8 and 9). The configuration of the warp restraint 300, and specifically the configuration of the first bearing 310 and the second opposing bearing 340, bias or co-act to provide biasing forces on the bolster 40 and the side frame 60 toward the normal square position to reduce, inhibit, and/or minimize warping.

Likewise, example warp restraint 400 includes a first bearing 410 integrally formed with a first portion of the bolster 40 and a second opposing bearing 440 integrally formed with the first side frame 60. It should be appreciated that the first bearing 410 may be connected to the bolster 40 by one or more suitable first bearing connecters (not shown). It should also be appreciated that the second bearing 440 may be connected to the bolster 40 by one or more suitable second bearing connecters (not shown).

More specifically, as shown in FIGS. 8 and 9, the first bearing 410 includes: (a) a substantially horizontally extending mounting bracket 412 integrally connected to the bolster 40; (b) a movable engagement pad 414 pivotally connected to the mounting bracket 412; (c) a connection arm 413 extending transversely from the back of the engagement pad 414; and (d) a pivot pin (not shown). The movable engagement pad 414 is pivotally connected to the mounting bracket 412 by the connection arm 413 and by the pivot pin (not shown). The engagement pad 414 includes an inner substantially vertically extending engagement surface 414*a*. In this illustrated embodiment, the engagement pad 414 includes a mounting base 415 and a wear member 416 removably connected to the mounting base 415 by one or more suitable fasteners (not shown).

In this illustrated embodiment, the engagement pad 414 is pivotal about a horizontally or substantially horizontally extending axis (not shown) extending through the pivot pin (not shown). It should be appreciated that in various alternative embodiments of the present disclosure, the mounting bracket 412, the engagement pad 414, the connection arm 413, and the pivot pin can be configured such that the engagement pad 414 pivots about a differently extending axis.

In this illustrated embodiment, the engagement pad 414 and/or the engagement surface 414*a* extends in the same direction (such as parallel) to the centerline, center plane, or center axis of the bolster (that in turn extends transversely relative to straight tracks). It should be appreciated that in various alternative embodiments of the present disclosure, the engagement pad 414 and/or the engagement surface 414*a* is: (a) angled outwardly; (b) angled inwardly; (c) initially angled upwardly; (d) initially angled downwardly; (e) initially angled outwardly and upwardly; (f) initially angled outwardly and downwardly; (g) initially angled inwardly and upwardly; or (h) initially angled inwardly and downwardly, to assist in providing the desired forces on the bolster 40 and the side frames 60 and 80 to reduce, inhibit, and/or minimize warping of the side frames 60 and 80 relative to the bolster 40. Thus, in various embodiments, the angle between: (a) a plane extending through the engagement pad 414 or along the engagement surface 414*a* in its initial position; relative to: (b) a plane extending through the side frame 60 may be right (as shown in FIGS. 8 and 9), may be obtuse, or may be acute.

As also shown in FIGS. 8 and 9, the second bearing 440 includes: (a) a substantially vertically extending side frame mounting wall 442 integrally connected to the outer surface of the side frame 60; (b) a substantially vertically extending engagement wall 444 integrally connected to the side frame mounting wall 442 and extending inwardly transversely from the side frame mounting wall 442; (c) a substantially vertically extending engagement pad 446 integrally connected to the engagement wall 444; and (d) a plurality of substantially horizontally extending braces (such as brace 448*a*, brace 448*b*, brace 448*c*, and brace 448*d*) each integrally connected to the side frame mounting wall 442 and integrally connected to the engagement wall 442.

The engagement wall 444 includes an inner substantially vertically extending engagement side 444*a* (that extends substantially parallel with the center line, center plane, or center axis of the bolster). The engagement pad 446 includes an inner substantially vertically extending engagement surface 446*a* (that extends substantially parallel with the crosswise axis of the bolster). It should be appreciated that in various alternative embodiments of the present disclosure, the engagement wall 444, the engagement side 444*a*, the engagement pad 446, and/or the engagement surface 446*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 40 and the side frames 60 and 80 to reduce, inhibit, or minimize warping of the side frames 60 and 80 relative to the bolster 40 as further described below. Thus, in various embodiments, the angle between: (a) a plane extending through the engagement wall 444, along the engagement side 444*a*, through the engagement pad 446, or through the engagement surface 446*a*; relative to: (b) a plane extending through the side frame 60 may be right (as shown in FIGS. 8 and 9), may be obtuse, or may be acute.

The first bearing 410 and the second opposing bearing 440 are thus configured to engage each other (as generally shown in FIGS. 8 and 9). More specifically, the engagement surface 414*a* of the engagement pad 414 is configured to engage the engagement surface 446*a* of the engagement pad 446. The configuration of the warp restraint 400, and specifically the configuration of the first bearing 410 and the second opposing bearing 440, bias or co-act to provide biasing forces on the bolster 40 and the side frame 60 toward the normal square position to reduce, inhibit, or minimize warping as further described below.

In this embodiment, the removable wear members 316 and 416 of the respective engagement pads 314 and 414 of the bearings can be made from a relatively hard plastic material with self-lubricating characteristics such as from an acetal resin such as a DELRIN material.

In this example embodiment, engagement pads 346 and 446 are made from suitable steel for strength.

It should be appreciated that in various embodiments, the removable wear members 316 and 416 are respectively removably attached to the mounting bases 315 and 415 to facilitate replacement of such wear members as they wear out.

In various such embodiments, before replacement but after the wear members are worn to a certain degree, suitable shims (not shown) may be employed to maintain engagement between the respective sets of first and second bearings.

In various other such embodiments, one or more of the first and second bearings can include one or more biasing members (not shown) to maintain engagement between the respective sets of first and second bearings.

In various other such embodiments, one or more adjustment devices (not shown) can be used with the bearing members to maintain engagement between the respective sets of first and second bearings. In various embodiments, the adjustment devices include opposing threaded members that are rotatably adjustable to maintain engagement between the respective sets of first and second bearings.

It should be appreciated that bearing 110 (and specifically the mounting bracket 112 thereof), bearing 210 (and specifically the mounting bracket 212 thereof), bearing 510 (and specifically the mounting bracket thereof), and bearing 610 (and specifically the mounting bracket thereof) can be integrally cast with the bolster 40 in various embodiments of the present disclosure. Likewise, it should be appreciated that bearing 140 (and specifically the mounting wall 142 thereof) and bearing 240 (and specifically the mounting wall 242 thereof) can be integrally cast with the side frame 60 in various embodiments of the present disclosure. Likewise, it should be appreciated that bearing 540 (and specifically the mounting wall thereof) and bearing 640 (and specifically the mounting wall thereof) can be integrally cast with the side frame 80 in various embodiments of the present disclosure.

Warp restraints 700 and 800 of the present disclosure are identical to warp restraints 300 and 400 except that warp restraints 700 and 800 are attached to the second side frame 80 and the second portion of the bolster 40.

When warping begins to occur or occurs as generally shown in FIG. 2, the bolster 40 is not square with either of the side frames 60 or 80. Warping is somewhat of a particular combination of forces wherein each end of the bolster wants to twist inside of the aperture of the respective side frame. The warp restraints 100, 200, 300, 400, 500, 600, 700, and 800 of the present disclosure can: (1) independently apply counter biasing forces to the bolster 40; and (2) apply counter biasing forces to the bolster 40 in groups, wherein such forces act independently or in combination or co-act to cause the bolster 40 to return to its normal position and thus reduce, inhibit, and/or minimize warping. Specifically, in certain embodiments, depending upon the specific positioning, arrangements, and configurations of the respective engagement pads, the engagement pads will exert opposing forces on the opposing bearings to move away from such positions and back toward their normal positions.

The eight warp restraints 100, 200,300, 400, 500, 600, 700, and 800 of this example embodiment of the present disclosure thus act independently and co-act in groups to bias the bolster toward the square positions relative to the side frames 60 and 80 such that the centerline or center plane of the bolster (that extends transversely relative to straight tracks) is perpendicular or substantially perpendicular to the centerlines or center planes of the respective side frames 60 and 80 (that extend longitudinally relative to straight tracks).

In further alternative example embodiments of the railroad car truck with warp restraints of the present disclosure that are not shown, the railroad car truck with warp restraints includes: (a) the third plurality or set of warp restraints 300 and 400; and (b) the fourth plurality or set of warp restraints 700 and 800, but do not include: (1) the first plurality or set of warp restraints 100 and 200; and (2) the second plurality or set of warp restraints 500 and 600.

$4^{th}$ Example Embodiment

Referring now to FIGS. 10A, 10B, 11, 12, and 13, another example embodiment of the railroad car truck with warp restraints of the present disclosure is shown and generally indicated by numeral 2050. In this illustrated example embodiment of the present disclosure, the truck 2050 includes a bolster 2040, a bolster bowl 2042 on the bolster 2040, a first side frame 2060, and a second side frame 2080. Generally, the bolster 2040 is configured to extend transversely to the direction of the railroad tracks or rails (not shown in FIGS. 10A, 10B, 11, 12, and 13) and the side frames 2060 and 2080 are configured to extend longitudinally in the same direction as the railroad tracks (not shown in FIGS. 10A, 10B, 11, 12, and 13). The side frame 2060 includes: (a) a longitudinally extending body 2062; and (b) two downwardly extending pedestal jaws (including a first pedestal jaw 2064 and a second pedestal jaw 2066) on opposite sides of the center opening 2068 in the body 2062 of the side frame 2060. The body 2062 includes a first side wall, a top wall, a second side wall, and a bottom wall that generally define the opening 2068. The side frame 2080 includes: (a) a longitudinally extending body 2082; and (b) two downwardly extending pedestal jaws (including a first pedestal jaw 2084 and a second pedestal jaw 2086) on opposite sides of the center opening 2088 in the body 2082 of the side frame 2080. The body 2082 includes a first side wall, a top wall, a second side wall, and a bottom wall that generally define the opening 2088.

In this illustrated example embodiment of the present disclosure, as shown in FIGS. 10A, 10B, 11, 12, and 13, the railroad car truck with warp restraints 2050 includes: (1) a first plurality or set of warp restraints 2100 and 2200; and (2) a second plurality or set of warp restraints 2500 and 2600. More specifically, in this illustrated embodiment: (a) warp restraint 2100 includes a first bearing 2110 integrally formed at and extending from a first portion of the bolster 2040 and a second opposing bearing 2140 integrally formed at and extending from the first side frame 2060; (b) warp restraint 2200 includes a first bearing 2210 integrally formed at and extending from the first portion of the bolster 2040 and a second opposing bearing 2240 integrally formed at and extending from the first side frame 2060; (c) warp restraint 2500 includes a first bearing 2510 integrally formed at and extending from a second portion of the bolster 2040 and a second opposing bearing 2540 integrally formed at and extending from the second side frame 2080; and (d) warp restraint 2600 includes a first bearing 2610 integrally formed at and extending from the second end portion of the bolster 2040, a second opposing bearing 2640 integrally formed at and extending from the second side frame 2080. Thus, bearings 2110, 2210, 2510, and 2610 are integrally formed at and extend from the respective inward portions of the bolster 2040, bearings 2140 and 2240 are integrally formed at and extend from the inward side of the first side frame 2060, and bearings 2540 and 2640 are integrally formed at and extend from the inward side of the second side frame 2080.

It should be appreciated that each of the warp restraints 2100, 2200, 2500, and 2600 in various embodiments are identical or substantially identical (except for positioning and arrangement of their connectors to, connections with, or formations with the side frames and the bolster). Therefore, warp restraints 2100 and 2200 are primarily discussed in further detail below. However, it should be appreciated that the warp restraints of the present disclosure do not need to be identical or substantially identical and can vary based on the respective positions and connections to or formations with the side frames and the bolster. For example, the two bearings of any set of warp restraints may be different. It should also be appreciated that the warp restraint of the various different embodiments of the present disclosure may be used on a truck (i.e., the various example warp restraints of the present disclosure may be mixed on single truck or railroad car).

More specifically, example warp restraint 2100 includes a first bearing 2110 integrally formed with a first portion of the bolster 2040 and a second opposing bearing 2140 integrally formed with the first side frame 2060. It should be appreciated that the first bearing 2110 may be connected to the bolster 2040 by one or more suitable first bearing connecters (not shown). It should also be appreciated that the second bearing 2140 may be connected to the bolster 2040 by one or more suitable second bearing connecters (not shown).

Figure 11:
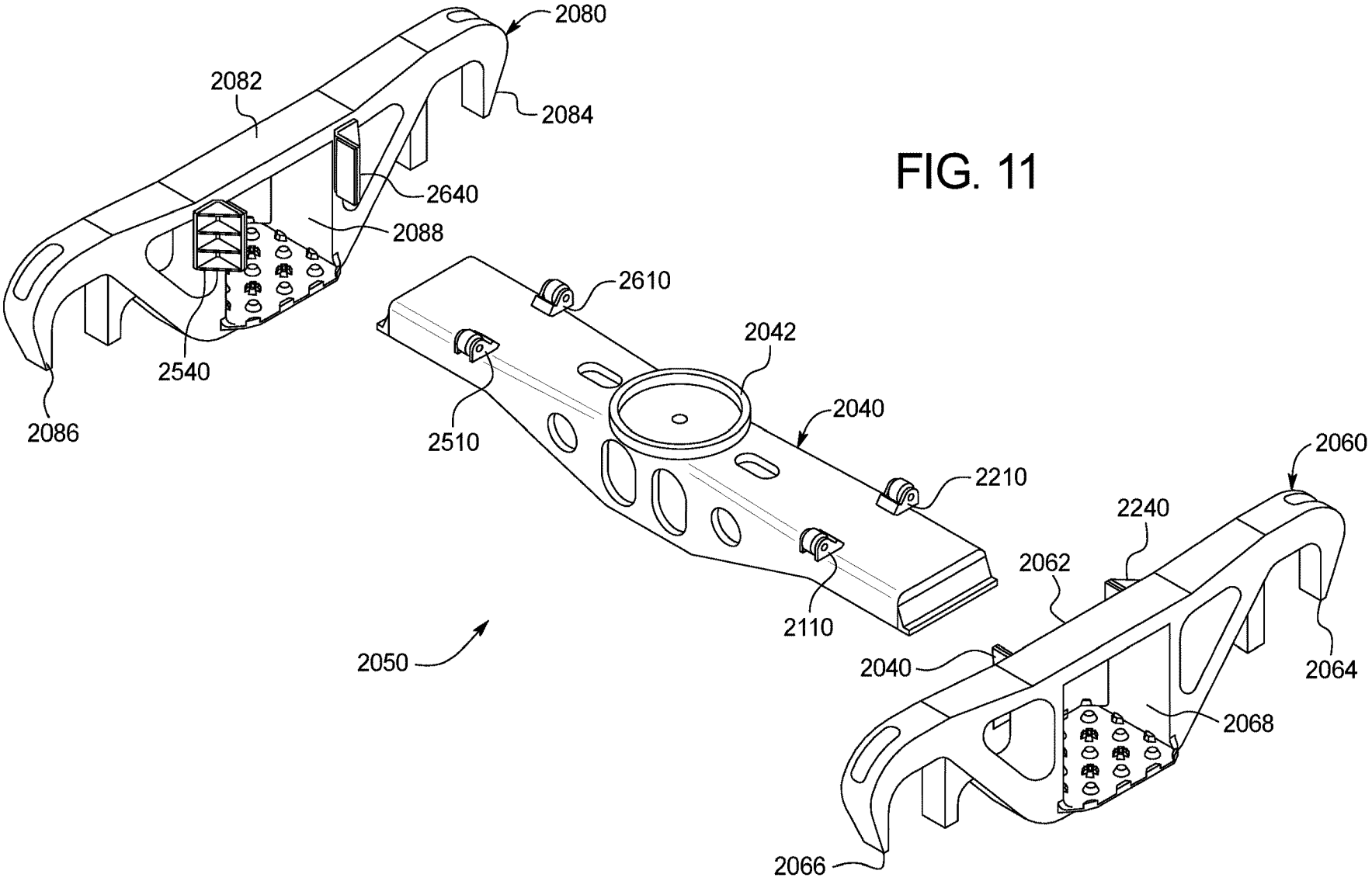
FIG. 11 is an exploded perspective view of the bolster, two side frames, and four warp restraints of the freight railroad car truck of FIG. 10A, and illustrating the bearings of the warp restraints integrally cast with the bolster and the bearings of the warp restraints integrally cast with the respective side frames.

As best shown in FIGS. 10 and 11, the first bearing 2110 includes: (a) a substantially horizontally extending mounting bracket 2112 integrally connected to the bolster 2040; (b) a rotatable engagement roller 2114 rotatably connected to the mounting bracket 2112; and (c) a pivot pin 2115. The rotatable engagement roller 2114 is rotatably connected to the mounting bracket 2112 by the pivot pin 2115. The engagement roller 2114 includes a substantially cylindrical engagement surface 2114*a* which at any point in time in its rotation includes a portion or engagement edge that is configured to engage the second bearing 2140. In this illustrated embodiment, the engagement roller 2114 is rotatable about a horizontally or substantially horizontally extending axis (not shown) extending through the pivot pin 2115. It should be appreciated that in various alternative embodiments of the present disclosure, the mounting bracket 2112, the engagement roller 2114, and the pivot pin 2115 can be configured such that the engagement roller 2114 is rotatable about a differently extending axis.

In this illustrated embodiment, the portion or engagement edge of the engagement roller 2114 and/or the engagement surface 2114*a* that engages bearing 2100 extends in the same direction (such as parallel) to the centerline, center plane, or center axis of the bolster (that in turn extends transversely relative to straight tracks). It should be appreciated that in various alternative embodiments of the present disclosure, the engagement roller 2114 and/or the engagement edge of the engagement surface 2114*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly to provide the desired forces on the bolster 2040 and the side frames 2060 and 2080 to reduce, inhibit, or minimize warping of the side frames 2060 and 2080 relative to the bolster 2040. Thus, in various embodiments, the angle between: (a) a plane extending through the engagement edge of the engagement roller 2114; relative to: (b) a plane extending through the side frame 60 may be right (as shown in FIGS. 10 and 11), may be obtuse, or may be acute.

Figure 12:
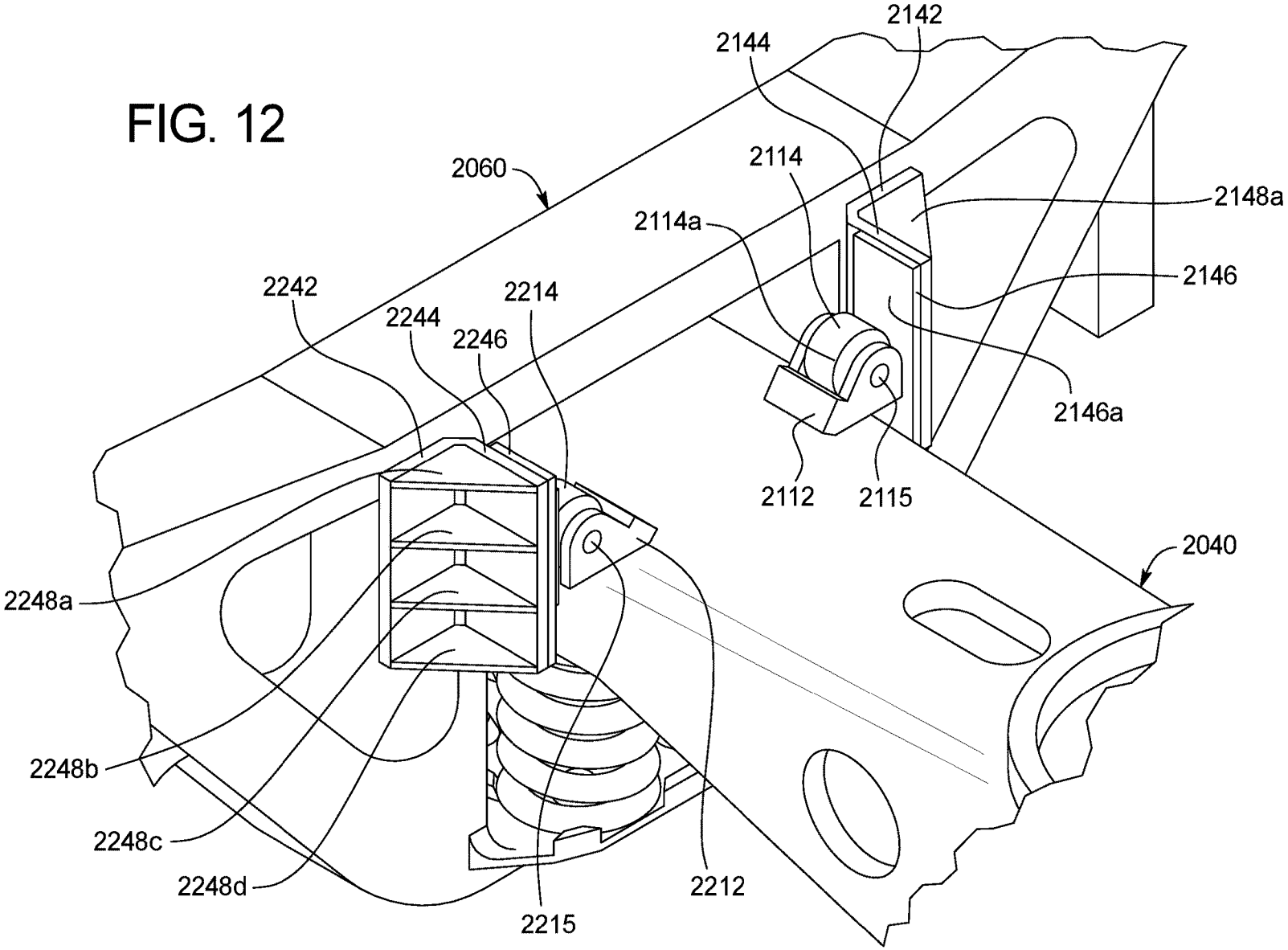
FIG. 12 is an enlarged fragmentary perspective view of the bolster, one of the side frames, and two warp restraints of the freight railroad car truck of FIG. 10A, and illustrating the bearings of the warp restraints integrally cast with the bolster and the bearings of the warp restraints integrally cast with the side frame.
Figure 13:
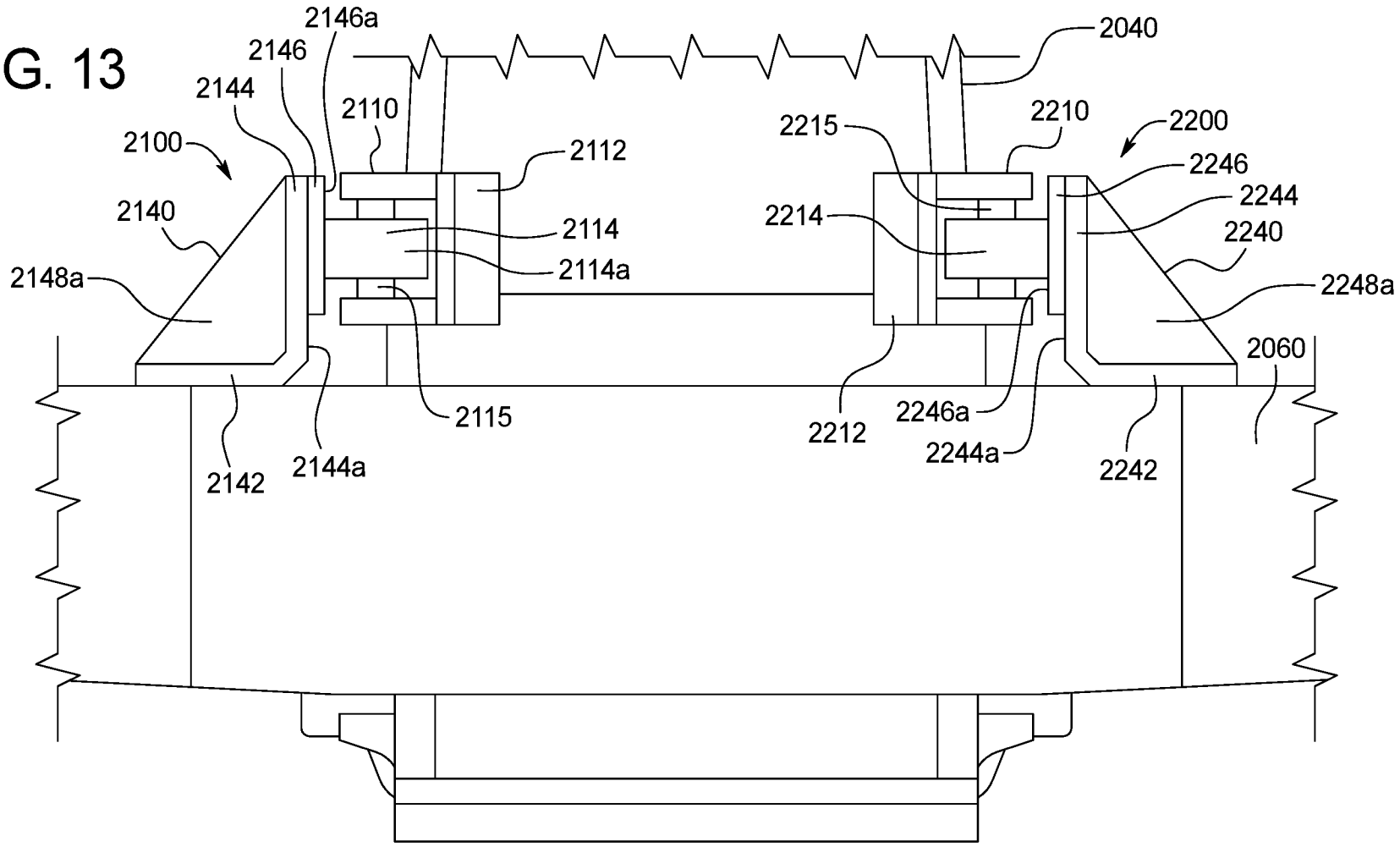
FIG. 13 is an enlarged fragmentary top view one end portion of the bolster, a first one of the side frames, and a first one of the two sets of warp restraints of the freight railroad car truck of FIG. 10A.

As best shown in FIGS. 12 and 13, the second bearing 2140 includes: (a) a substantially vertically extending side frame mounting wall 2142 integrally connected to the inner surface of the side frame 2060; (b) a substantially vertically extending engagement wall 2144 integrally connected to the side frame mounting wall 2142 and extending inwardly transversely from the side frame mounting wall 2142; (c) a substantially vertically extending engagement pad 2146 integrally connected to the engagement wall 2144; and (d) a plurality of substantially horizontally extending braces (such as brace 2148*a*) each integrally connected to the side frame mounting wall 2142 and integrally connected to the engagement wall 2142. The engagement wall 2144 includes an inner substantially vertically extending engagement side 2144*a*. The engagement pad 2146 includes an inner substantially vertically extending engagement surface 2146*a*.

In this illustrated embodiment, the engagement wall 2144, the engagement side 2144*a*, the engagement pad 2146, and the engagement surface 2146*a* also extend in the same direction (such as parallel) to the centerline, center plane, or central axis of the bolster (that in turn extends transversely relative to straight tracks). It should be appreciated that in various alternative embodiments of the present disclosure, the engagement wall 2144, the engagement side 2144*a*, the engagement pad 2146, and/or the engagement surface 2146*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 2040 and the side frames 2060 and 2080 to reduce, inhibit, and/or minimize warping of the side frames relative to the bolster 2040. Thus, in various embodiments, the angle between: (a) a plane extending through the engagement wall 2144, along the engagement side 2144*a*, through the engagement pad 2146, or through the engagement surface 2146*a*; relative to: (b) a plane extending through the side frame 2060 may be right (as shown in FIGS. 12 and 13), may be obtuse, or may be acute.

The first bearing 2110 and the second opposing bearing 2140 are thus configured to engage each other (as generally shown in FIGS. 10A, 10B, 11, 12, and 13). More specifically, the engagement edge of the engagement roller 2114 is configured to engage the engagement surface 2146*a* of the engagement pad 2146 (as shown in FIGS. 11 and 12). The configuration of the warp restraint 2100, and specifically the configuration of the first bearing 2110 and the second opposing bearing 2140, bias or co-act to provide biasing forces on the bolster 2040 and the side frame 2060 toward the normal square position to reduce, inhibit, and/or minimize warping.

Likewise, example warp restraint 2200 includes a first bearing 2210 integrally formed with a first portion of the bolster 2040 and a second opposing bearing 2240 integrally formed with the first side frame 2060. It should be appreciated that the first bearing 2210 may be connected to the bolster 2040 by one or more suitable first bearing connecters (not shown). It should also be appreciated that the second bearing 2240 may be connected to the bolster 2040 by one or more suitable second bearing connecters (not shown).

More specifically, as best shown in FIGS. 12 and 13, the first bearing 2210 includes: (a) a substantially horizontally extending mounting bracket 2212 integrally connected to the bolster 2040; (b) an engagement roller 2214 rotatably connected to the mounting bracket 2212; and (c) a pivot pin 2215. The engagement roller 2214 is rotatably connected to the mounting bracket 2212 by the pivot pin 2115. The engagement roller 2214 includes a cylindrical engagement surface 2214*a* which at any point in time in its rotation includes a portion or engagement edge that is configured to engage the second bearing 2240. In this illustrated embodiment, the engagement roller 2214 is rotatable about a horizontally or substantially horizontally extending axis (not shown) extending through the pivot pin 2115. It should be appreciated that in various alternative embodiments of the present disclosure, the mounting bracket 2212, the engagement roller 2214, and the pivot pin 2215 can be configured such that the engagement roller 2214 rotates about a differently extending axis.

It should be appreciated that in various alternative embodiments of the present disclosure, the engagement roller 2214 is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 2040 and the side frames 2060 and 2080 to reduce, inhibit, or minimize warping of the side frames 2060 and 2080 relative to the bolster 2040. Thus, in various embodiments, the angle between: (a) a plane extending through the engagement pad 2214 or along the engagement edge of the engagement surface 2214*a*; relative to: (b) a plane extending through the side frame 60 may be right (as shown in FIGS. 12 and 13), may be obtuse, or may be acute.

As best shown in FIGS. 12 and 13, the second bearing 2240 includes: (a) a substantially vertically extending side frame mounting wall 2242 integrally connected to the inner surface of the side frame 2040; (b) a substantially vertically extending engagement wall 2244 integrally connected to the side frame mounting wall 2242 and extending inwardly transversely from the side frame mounting wall 2242; (c) a substantially vertically extending engagement pad 2246 integrally connected to the engagement wall 2244; and (d) a plurality of substantially horizontally extending braces (such as braces 2248*a*, 2248*b*, 2248*c*, and 2248*d*) each integrally connected to the side frame mounting wall 2242 and integrally connected to the engagement wall 2242. The engagement wall 2244 includes an inner substantially vertically extending engagement side 2244*a* (that extends substantially parallel with the crosswise axis of the bolster). The engagement pad 2246 includes an inner substantially vertically extending engagement surface 2246*a* (that extends substantially parallel with the crosswise axis of the bolster). It should be appreciated that in various alternative embodiments of the present disclosure, the engagement wall 2244, the engagement side 2244*a*, the engagement pad 2246, and/or the engagement surface 2246*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 2040 and the side frames 2060 and 2080 to reduce, inhibit, or minimize warping of the side frames relative to the bolster. Thus, in various embodiments, the angle between: (a) a plane extending through the engagement wall 2244, along the engagement side 2244*a*, through the engagement pad 2246, or through the engagement surface 2246*a*; relative to: (b) a plane extending through the side frame 2060 may be right (as shown in FIGS. 12 and 13), may be obtuse, or may be acute.

The first bearing 2210 and the second opposing bearing 2240 are thus configured to engage each other (as generally shown in FIGS. 10A, 10B, 11, 12, and 13). More specifically, the engagement edge of the engagement roller 2214 is configured to engage the engagement surface 2246*a* of the engagement pad 2246 (as shown in FIGS. 12 and 13). The configuration of the warp restraint 2200, and specifically the configuration of the first bearing 2210 and the second opposing bearing 2240, bias or co-act to provide biasing forces on the bolster 2040 and the side frame 2060 toward the normal square position to reduce, inhibit, and/or minimize warping.

In this illustrated example embodiment, the engagement pads 2146 and 2246 are steel and the rollers 2114 and 2214 are made from steel. It should be appreciated that these engaging components can be made from other suitable materials.

It should also be appreciated that the rollers of the warp restraints are identical in the illustrated embodiments of FIGS. 10A, 10B, 11, 12 and 13, but may be different, and in particular may have different roller sizes (such as different roller outer diameters or different roller elasticity or spring characteristics).

In various such embodiments, before replacement but after the wear members are worn to a certain degree, suitable shims (not shown) may be employed to maintain engagement between the respective sets of first and second bearings.

In various other such embodiments, one or more of the first and second bearings can include one or more biasing members (not shown) to maintain engagement between the respective sets of first and second bearings.

In various other such embodiments, one or more adjustment devices (not shown) can be used with the bearing members to maintain engagement between the respective sets of first and second bearings. In various embodiments, the adjustment devices include opposing threaded members that are rotatably adjustable to maintain engagement between the respective sets of first and second bearings.

It should be appreciated that bearing 2110 (and specifically the mounting bracket 2112 thereof), bearing 2210 (and specifically the mounting bracket 2212 thereof), bearing 2510 (and specifically the mounting bracket thereof), and bearing 2610 (and specifically the mounting bracket thereof) can be integrally cast with the bolster 2040 in various embodiments of the present disclosure. Likewise, it should be appreciated that bearing 2140 (and specifically the mounting wall 2142 thereof) and bearing 2240 (and specifically the mounting wall 2242 thereof) can be integrally cast with the side frame 2060 in various embodiments of the present disclosure. Likewise, it should be appreciated that bearing 2540 (and specifically the mounting wall thereof) and bearing 2640 (and specifically the mounting wall thereof) can be integrally cast with the side frame 2080 in various embodiments of the present disclosure.

$5^{th}$ Example Embodiment

Figure 14:
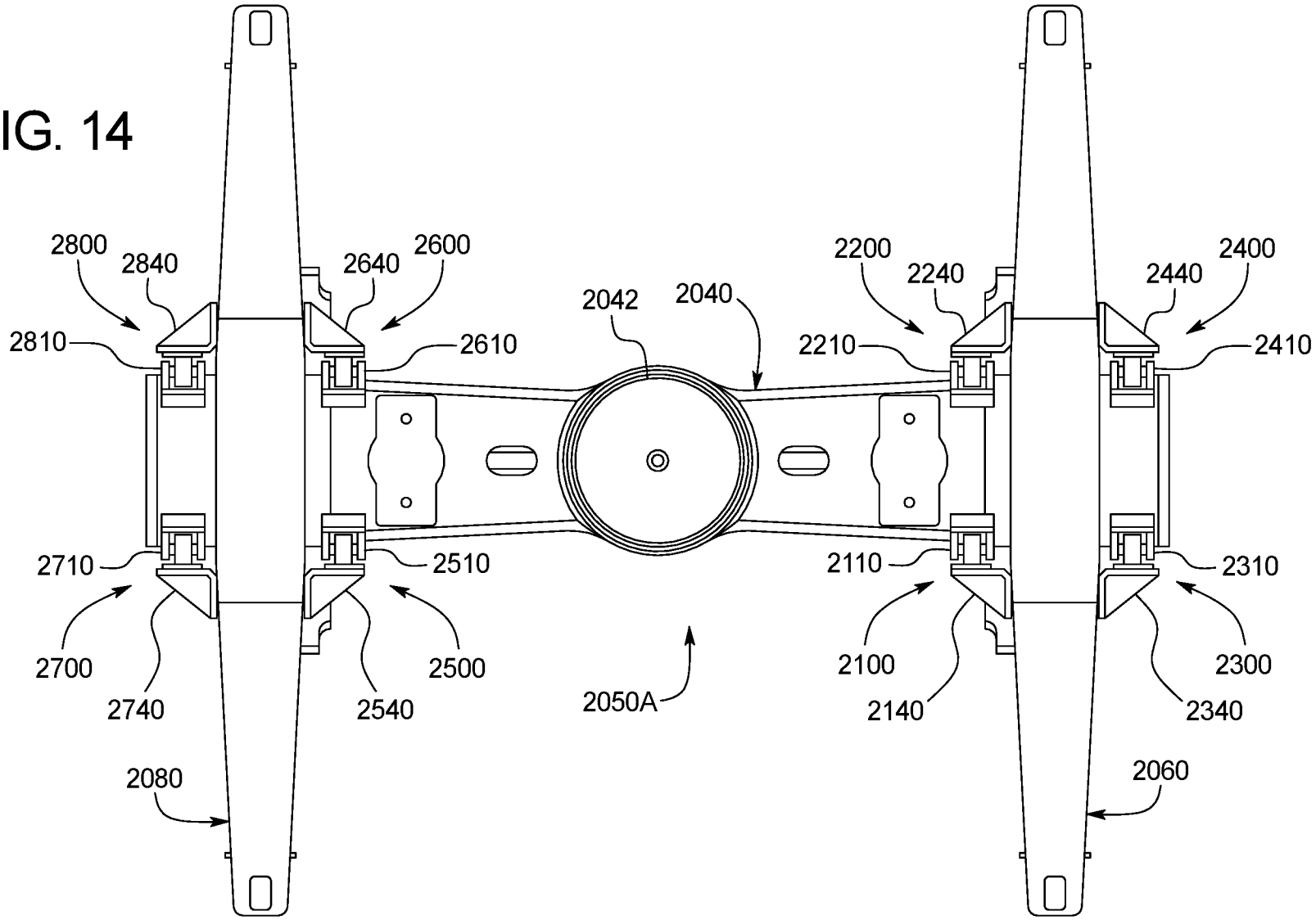
FIG. 14 is an enlarged top view of a bolster, two side frames, and eight warp restraints of another example embodiment of the freight railroad car truck of the present disclosure.
Figure 15:
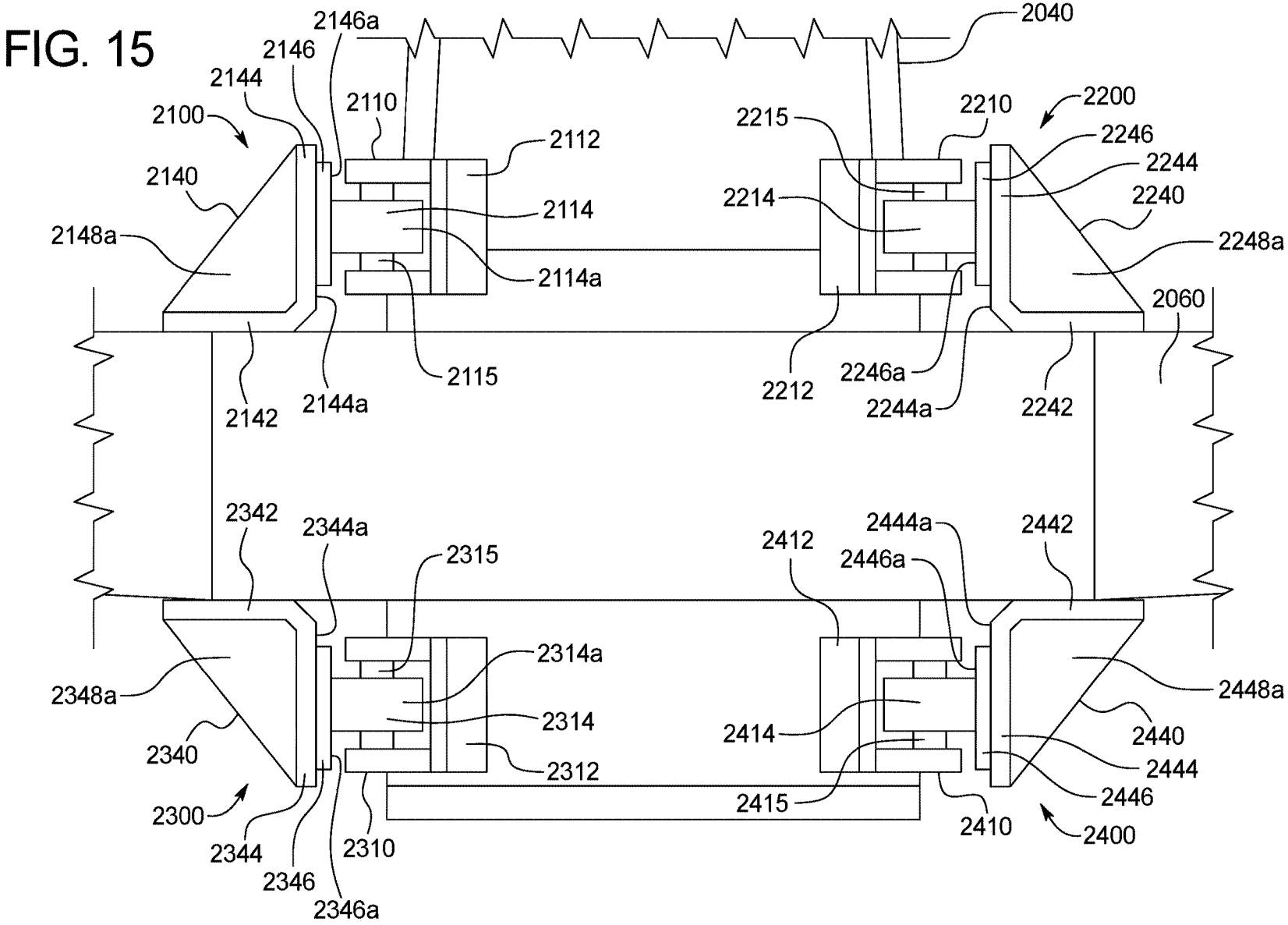
FIG. 15 is an enlarged fragmentary top view of one end portion of the bolster, a first one of the side frames, and four of the warp restraints of the freight railroad car truck of FIG. 14.

Referring now to FIGS. 14 and 15, another example embodiment of the railroad car truck with warp restraints of the present disclosure is shown and generally indicated by numeral 2050A.

In this illustrated example embodiment of the present disclosure, the railroad car truck with warp restraints 2050A includes: (1) a first plurality or set of warp restraints 2100 and 2200; (2) a second plurality or set of warp restraints 2500 and 2600; (3) a third plurality or set of warp restraints 2300 and 2400; and (4) a fourth plurality or set of warp restraints 2700 and 2800. In this illustrated example embodiment of the present disclosure: (1) the first plurality or set of warp restraints 2100 and 2200 are the same as the warp restraints 2100 and 2200 of FIG. 10A to 13; and (2) the second plurality or set of warp restraints 2500 and 2600 are the same as the warp restraints 2500 and 2600 of FIGS. 10A to 13. Thus, these warp restraints are indicated by the same numerals as in FIGS. 10A to 13, are not described again in this section, and the above descriptions apply to such warp restraints.

Warp restraints 2300, 2400, 2700, and 2800 are similar to warp restraints 2100, 2200, 2500, and 2600, and are thus similarly described below.

In this illustrated embodiment: (a) warp restraint 2300 includes a first bearing 2310 integrally formed at and extending from a first portion of the bolster 2040 and a second opposing bearing 2340 integrally formed at and extending from the first side frame 2060; (b) warp restraint 2400 includes a first bearing 2410 integrally formed at and extending from the first portion of the bolster 2040 and a second opposing bearing 2440 integrally formed at and extending from the first side frame 2060; (c) warp restraint 2700 includes a first bearing 2710 integrally formed at and extending from a second portion of the bolster 2040 and a second opposing bearing 2740 integrally formed at and extending from the second side frame 2080; and (d) warp restraint 2800 includes a first bearing 2810 integrally formed at and extending from the second end portion of the bolster 2040, a second opposing bearing 2840 integrally formed at and extending from the second side frame 2080. Thus, bearings 2310, 2410, 2710, and 2810 are integrally formed at and extend from the respective outer portions of the bolster 2040, bearings 2340 and 2440 are integrally formed at and extend from the outer side of the first side frame 2060, and bearings 2740 and 2840 are integrally formed at and extend from the outer side of the second side frame 2080.

It should be appreciated that each of the warp restraints 2300, 2400, 2700, and 2800 in various embodiments are identical or substantially identical (except for positioning and arrangement of their connectors to, connections with, or formations with the side frames and the bolster). Therefore, warp restraints 2300 and 2400 are primarily discussed in further detail below. However, it should be appreciated that the warp restraints of the present disclosure do not need to be identical or substantially identical and can vary based on the respective positions and connections to or formations with the side frames and the bolster. For example, the two bearings of any set of warp restraints may be different. It should also be appreciated that the warp restraint of the various different embodiments of the present disclosure may be used on a truck (i.e., the various example warp restraints of the present disclosure may be mixed on single truck or railroad car).

More specifically, example warp restraint 2300 includes a first bearing 2310 integrally formed with a first portion of the bolster 2040 and a second opposing bearing 2340 integrally formed with the first side frame 2060. It should be appreciated that the first bearing 2310 may be connected to the bolster 2040 by one or more suitable first bearing connecters (not shown). It should also be appreciated that the second bearing 2340 may be connected to the bolster 2040 by one or more suitable second bearing connecters (not shown).

As shown in FIGS. 14 and 15, the first bearing 2310 includes: (a) a substantially horizontally extending mounting bracket 2312 integrally connected to the bolster 2040; (b) a rotatable engagement roller 2314 rotatably connected to the mounting bracket 2312; and (c) a pivot pin 2315. The rotatable engagement roller 2314 is rotatably connected to the mounting bracket 2312 by the pivot pin 2315. The engagement roller 2314 includes a substantially cylindrical engagement surface 2314*a* which at any point in time in its rotation includes a portion or engagement edge that is configured to engage the second bearing 2340. In this illustrated embodiment, the engagement roller 2314 is rotatable about a horizontally or substantially horizontally extending axis (not shown) extending through the pivot pin 2315. It should be appreciated that in various alternative embodiments of the present disclosure, the mounting bracket 2312, the engagement roller 2314, and the pivot pin 2315 can be configured such that the engagement roller 2314 is rotatable about a differently extending axis.

In this illustrated embodiment, the portion or engagement edge of the engagement roller 2314 and/or the engagement surface 2314*a* that engages bearing 2100 extends in the same direction (such as parallel) to the centerline, center plane, or center axis of the bolster (that in turn extends transversely relative to straight tracks). It should be appreciated that in various alternative embodiments of the present disclosure, the engagement roller 2314 and/or the engagement edge of the engagement surface 2314*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly to provide the desired forces on the bolster 2040 and the side frames 2060 and 2080 to reduce, inhibit, or minimize warping of the side frames 2060 and 2080 relative to the bolster 2040. Thus, in various embodiments, the angle between: (a) a plane extending through the engagement edge of the engagement roller 2314; relative to: (b) a plane extending through the side frame 60 may be right (as shown in FIGS. 14 and 15), may be obtuse, or may be acute.

As also shown in FIGS. 14 and 15, the second bearing 2340 includes: (a) a substantially vertically extending side frame mounting wall 2342 integrally connected to the outer surface of the side frame 2060; (b) a substantially vertically extending engagement wall 2344 integrally connected to the side frame mounting wall 2342 and extending inwardly transversely from the side frame mounting wall 2342; (c) a substantially vertically extending engagement pad 2346 integrally connected to the engagement wall 2344; and (d) a plurality of substantially horizontally extending braces (such as brace 2348*a*) each integrally connected to the side frame mounting wall 2342 and integrally connected to the engagement wall 2342. The engagement wall 2344 includes an inner substantially vertically extending engagement side 2344*a*. The engagement pad 2146 includes an inner substantially vertically extending engagement surface 2346*a*.

In this illustrated embodiment, the engagement wall 2344, the engagement side 2344*a*, the engagement pad 2346, and the engagement surface 2346*a* also extend in the same direction (such as parallel) to the centerline, center plane, or central axis of the bolster (that in turn extends transversely relative to straight tracks). It should be appreciated that in various alternative embodiments of the present disclosure, the engagement wall 2344, the engagement side 2344*a*, the engagement pad 2346, and/or the engagement surface 2346*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 2040 and the side frames 2060 and 2080 to reduce, inhibit, and/or minimize warping of the side frames relative to the bolster 2040. Thus, in various embodiments, the angle between: (a) a plane extending through the engagement wall 2344, along the engagement side 2344*a*, through the engagement pad 2346, or through the engagement surface 2346*a*; relative to: (b) a plane extending through the side frame 2060 may be right (as shown in FIGS. 14 and 15), may be obtuse, or may be acute.

The first bearing 2310 and the second opposing bearing 2340 are thus configured to engage each other (as shown in FIGS. 14 and 15). More specifically, the engagement edge of the engagement roller 2314 is configured to engage the engagement surface 2346*a* of the engagement pad 2346 (as shown in FIGS. 14 and 15). The configuration of the warp restraint 2300, and specifically the configuration of the first bearing 2310 and the second opposing bearing 2340, bias or co-act to provide biasing forces on the bolster 2040 and the side frame 2060 toward the normal square position to reduce, inhibit, and/or minimize warping.

Likewise, example warp restraint 2400 includes a first bearing 2410 integrally formed with a first portion of the bolster 2040 and a second opposing bearing 2440 integrally formed with the first side frame 2060. It should be appreciated that the first bearing 2410 may be connected to the bolster 2040 by one or more suitable first bearing connecters (not shown). It should also be appreciated that the second bearing 2440 may be connected to the bolster 2040 by one or more suitable second bearing connecters (not shown).

More specifically, as shown in FIGS. 14 and 15, the first bearing 2410 includes: (a) a substantially horizontally extending mounting bracket 2412 integrally connected to the bolster 2040; (b) an engagement roller 2414 rotatably connected to the mounting bracket 2412; and (c) a pivot pin 2415. The engagement roller 2414 is rotatably connected to the mounting bracket 2412 by the pivot pin 2415. The engagement roller 2414 includes a cylindrical engagement surface 2414*a* which at any point in time in its rotation includes a portion or engagement edge that is configured to engage the second bearing 2440. In this illustrated embodiment, the engagement roller 2414 is rotatable about a horizontally or substantially horizontally extending axis (not shown) extending through the pivot pin 2415. It should be appreciated that in various alternative embodiments of the present disclosure, the mounting bracket 2412, the engagement roller 2414, and the pivot pin 2415 can be configured such that the engagement roller 2414 rotates about a differently extending axis.

It should be appreciated that in various alternative embodiments of the present disclosure, the engagement roller 2414 is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 2040 and the side frames 2060 and 2080 to reduce, inhibit, and/or minimize warping of the side frames 2060 and 2080 relative to the bolster 2040. Thus, in various embodiments, the angle between: (a) a plane extending through the engagement pad 2414 or along the engagement edge of the engagement surface 2414*a*; relative to: (b) a plane extending through the side frame 2060 may be right (as shown in FIGS. 14 and 15), may be obtuse, or may be acute.

As also shown in FIGS. 14 and 15, the second bearing 2440 includes: (a) a substantially vertically extending side frame mounting wall 2442 integrally connected to the outer surface of the side frame 2040; (b) a substantially vertically extending engagement wall 2444 integrally connected to the side frame mounting wall 2442 and extending inwardly transversely from the side frame mounting wall 2442; (c) a substantially vertically extending engagement pad 2446 integrally connected to the engagement wall 2444; and (d) a plurality of substantially horizontally extending braces (such as braces 2448*a*, 2448*b*, 2448*c*, and 2448*d*) each integrally connected to the side frame mounting wall 2442 and integrally connected to the engagement wall 2444. The engagement wall 2444 includes an inner substantially vertically extending engagement side 2444*a* (that extends substantially parallel with the crosswise axis of the bolster). The engagement pad 2446 includes an inner substantially vertically extending engagement surface 2446*a* (that extends substantially parallel with the crosswise axis of the bolster). It should be appreciated that in various alternative embodiments of the present disclosure, the engagement wall 2444, the engagement side 2444*a*, the engagement pad 2446, and/or the engagement surface 2446*a* is: (a) angled outwardly; (b) angled inwardly; (c) angled upwardly; (d) angled downwardly; (e) angled outwardly and upwardly; (f) angled outwardly and downwardly; (g) angled inwardly and upwardly; or (h) angled inwardly and downwardly, to assist in providing the desired forces on the bolster 2040 and the side frames 2060 and 2080 to reduce, inhibit, or minimize warping of the side frames relative to the bolster as further described below. Thus, in various embodiments, the angle between: (a) a plane extending through the engagement wall 2444, along the engagement side 2444*a*, through the engagement pad 2446, or through the engagement surface 2446*a*; relative to: (b) a plane extending through the side frame 2060 may be right (as shown in FIGS. 14 and 15), may be obtuse, or may be acute.

The first bearing 2410 and the second opposing bearing 2440 are thus configured to engage each other (as shown in FIGS. 14 and 15). More specifically, the engagement edge of the engagement roller 2414 is configured to engage the engagement surface 2446*a* of the engagement pad 2446 (as shown in FIGS. 14 and 15). The configuration of the warp restraint 2400, and specifically the configuration of the first bearing 2410 and the second opposing bearing 2440, bias or co-act to provide biasing forces on the bolster 2040 and the side frame 2060 toward the normal square position to reduce, inhibit, and/or minimize warping.

It should also be appreciated that the rollers of the warp restraints are identical in the illustrated embodiments, but may be different, and in particular may have different roller sizes (such as different roller outer diameters or different roller elasticity or spring characteristics).

In this illustrated example embodiment, the engagement pads 2346 and 2446 are steel and the rollers 2314 and 2414 are made from steel. It should be appreciated that these engaging components can be made from other suitable materials.

In various such embodiments, before replacement but after the wear members are worn to a certain degree, suitable shims (not shown) may be employed to maintain engagement between the respective sets of first and second bearings.

In various other such embodiments, one or more of the first and second bearings can include one or more biasing members (not shown) to maintain engagement between the respective sets of first and second bearings.

In various other such embodiments, one or more adjustment devices (not shown) can be used with the bearing members to maintain engagement between the respective sets of first and second bearings. In various embodiments, the adjustment devices include opposing threaded members that are rotatably adjustable to maintain engagement between the respective sets of first and second bearings.

Warp restraints 2700 and 2800 of the present disclosure are identical to warp restraints 2300 and 2400 except that warp restraints 2700 and 2800 are attached to the second side frame 2080 and the second portion of the bolster 2040.

It should be appreciated that bearing 2110 (and specifically the mounting bracket 2112 thereof), bearing 2210 (and specifically the mounting bracket 2212 thereof), bearing 2510 (and specifically the mounting bracket thereof), and bearing 2610 (and specifically the mounting bracket thereof) can be integrally cast with the bolster 2040 in various embodiments of the present disclosure. Likewise, it should be appreciated that bearing 2140 (and specifically the mounting wall 2142 thereof) and bearing 2240 (and specifically the mounting wall 2242 thereof) can be integrally cast with the side frame 2060 in various embodiments of the present disclosure. Likewise, it should be appreciated that bearing 2540 (and specifically the mounting wall thereof) and bearing 2640 (and specifically the mounting wall thereof) can be integrally cast with the side frame 2080 in various embodiments of the present disclosure.

In further alternative example embodiments of the railroad car truck with warp restraints of the present disclosure that are not shown, the railroad car truck with warp restraints includes: (a) the third plurality or set of warp restraints 2300 and 2400; and (b) the fourth plurality or set of warp restraints 2700 and 2800, but does not include: (1) the first plurality or set of warp restraints 2100 and 2200; and (2) the second plurality or set of warp restraints 2500 and 2600.

It should be appreciated that the warp restraints of the present disclosure do not need to be identical or substantially identical and can vary based on the respective positions and connections to or formations with the side frames and the bolster. For example, the two bearings of any set of warp restraints may be different. It should also be appreciated that the warp restraint of the various different embodiments of the present disclosure may be used on a truck (i.e., the various example warp restraints of the present disclosure may be mixed on single truck or railroad car).

Additional Embodiments and Disclosure

It should be appreciated that in various embodiments and in various circumstances, the warp restraints of the present disclosure may also act to provide other biasing forces to the bolster relative to the side frames and/or may co-act with one or more other components of the railroad car truck to provide other biasing forces to the bolster relative to the side frames. These other biasing effects of the warp restraints of the present disclosure can be considered as secondary potential biasing effects.

More specifically, known prior art railroad cars trucks typically have bolsters that have free lateral or transverse movement relative to the side frames of around +/−½ inches, where the end of that lateral or transverse travel is limited by or arrested by stopping members that are often called "Gibs". Gibs are the physical blocks that prevent movement beyond this travel allowance. In certain embodiments of the present disclosure, the warp restraints replace or act with certain of the Gibs.

In the case where the warp restraints of the present disclosure replace certain of the Gibs, the bearings can perform certain of the functions of the Gibs. In the case where the warp restraints of the present disclosure do not replace the Gibs, the warp restraints will allow for limited lateral movement of the bolster relative to the side frames. In certain embodiments, depending upon the position, shape, and angles of the bearings, the warp restraints may assist or help to limit the lateral movement of the bolster relative to the side frames.

In another example of possible secondary biasing forces provided by the warp restraints of the present disclosure, the warp restraints may co-act with the springs or spring groups of the truck to provide biasing forces to the bolster relative to the side frames. The lateral or transverse movement of the bolster relative to the side frames is partially controlled by the equilibrium preference of the spring group on which the bolster rides. In other words, the spring groups provide lateral as well as vertical elasticity to the interaction between the bolster and the springs. More specifically, in certain embodiments of the warp restraints lateral biasing forces (beyond that provided by the spring group) are expected to be produced.

Thus, in certain circumstances and certain embodiments of the present disclosure, if the bolster moves laterally or transversely outwardly relative to the side frame, the warp restraints may be expected to exert certain biasing forces on those respective bearings, that will in turn transfer such forces to the bolster and the side frame to cause the bolster to move in an opposite direction laterally or transversely inwardly relative to the side frame and return to its normal position. Likewise, in certain circumstances and embodiments of the present disclosure, if the bolster moves laterally or transversely inwardly relative to the side frame, the warp restraints may be expected to exert certain biasing forces on those respective bearings, that will in turn transfer such forces to the bolster and the side frame to cause the bolster to move in an opposite direction laterally or transversely outwardly relative to the side frame and return to its normal position.

The warp restraints of certain embodiments of the present disclosure can also inhibit or reduce longitudinal movement of the bolsters relative to the side frames depending upon the shape and angles of the bearings. For example, if the bolster begins to move forward longitudinally relative to the side frame, the bearings can, in certain configurations, exert biasing forces on those respective bearing that will in turn transfer such forces to the bolster and the side frame to cause the bolster to move in an opposite direction rearwardly longitudinally relative to the side frame and return to its normal position. Likewise, if the bolster begins to move rearward longitudinally relative to the side frame, certain of the warp restraints can, in certain configurations, exert biasing forces on those respective warp restraints, that will in turn transfer such forces to the bolster and the side frame to cause the bolster to move in an opposite direction forwardly longitudinally relative to the side frame and return to its normal position.

It should also be appreciated that most movements of the bolster relative to the side frames will likely be in a direction that may be a combination of different directions, and that the warp restraints can act in combination or co-act with one or more other components of the truck to cause the bolster and side frames to move in opposing directions to return to their normal positions; thus, co-acting to prevent, reduce, or inhibit warping while also possibly applying other additional secondary forces as explained above.

Additionally, it should be appreciated that the warp restraints of the present disclosure can be employed to take up clearance between the side frame and bolster, thereby producing more resistance to truck warping.

As mentioned above, it should be appreciated that the bearings of the warp restraints may be differently formed, and in particular, the bearings may have different sizes such as diameters, thicknesses or widths, elasticity or spring characteristics and shapes.

It should be appreciated from the above that that over the expected life of certain of the bearings or engagement members thereof, it is expected that the size or width of the engagement member may decrease due to: (1) abrasion against the surfaces upon which the surfaces of that engagement member; (2) plastic deformation of the engagement member due to compression; (3) corrosion; and/or (4) other degenerative processes. In such case, the present disclosure contemplates replacement of such members, adjustment of the positions of such member (or other members), and/or other devices employed to facilitate necessary engagements.

It should further be appreciated that the warp restraints of the present disclosure require relatively little material or weight to the truck to provide additional stiffness.

It should be appreciated that in various embodiments, one or more of the surfaces of the bearings do not need any lubrication.

It should be appreciated that in various embodiments, one or more of the surfaces of the bearings are self-lubricating.

It should also be appreciated that one or more of the surfaces or engagement members will in certain embodiments have a high resistance to compressive forces such as compressive forces caused by warping. Such materials can for example include a composite polyester.

It will be understood that modifications and variations may be effected without departing from the scope of the novel concepts of the present invention, and it is understood that this application is to be limited only by the scope of the claims.

We claim:

1. A railroad car truck comprising:

a first side frame;

a second side frame;

a bolster;

a first plurality of warp restraints positioned at first inner portions of the bolster and the first side frame, each of the plurality of first warp restraints including:

(a) a first bearing connected to the bolster and including a movable engagement pad with a removable wear member, and (b) a second bearing connected to the first side frame, the second bearing including an engagement pad configured to be directly engaged by the removable wear member of the first bearing; and a second plurality of warp restraints positioned at second inner portions of the bolster and the second side frame, each of the plurality of second warp restraints including:

(a) a first bearing connected to the bolster and including a removable wear member, and (b) a second bearing connected to the second side frame, the second bearing including an engagement pad configured to be directly engaged by the removable wear member of the first bearing.

2. The railroad car truck of claim 1, wherein the removable wear member of each first bearing of the first plurality of warp restraints is removable.

3. The railroad car truck of claim 2, wherein the removable wear member of each first bearing of the second plurality of warp restraints is removable.

4. The railroad car truck of claim 1, wherein the removable wear member of each first bearing of the first plurality of warp restraints is pivotable.

5. The railroad car truck of claim 4, wherein the removable wear member of each first bearing of the second plurality of warp restraints is pivotable.

6. The railroad car truck of claim 1, wherein for each of the first warp restraints, the first bearing extends perpendicularly from the bolster, and for each of the second warp restraints, the first bearing extends perpendicularly from the bolster, wherein the movable engagement pad of the first bearing is angled outwardly, angled inwardly, initially angled upwardly, initially angled downwardly, initially angled outwardly and upwardly, initially angled outwardly and downwardly, initially angled inwardly and upwardly, or initially angled inwardly and downwardly.

7. The railroad car truck of claim 6, wherein for each of the first warp restraints, the second bearing extends perpendicularly from the first side frame, and for each of the second warp restraints, the second bearing extends perpendicularly from the second side frame.

8. The railroad car truck of claim 1, wherein for each of the first warp restraints, the second bearing extends perpendicularly from the first side frame, and for each of the second warp restraints, the second bearing extends perpendicularly from the second side frame.

9. The railroad car truck of claim 1, wherein the first inner portions are inwardly of an inner surface of the first side frame, and the second inner portions are inwardly of an inner surface of the second side frame.

10. A railroad car truck comprising:

a first side frame;

a second side frame;

a bolster;

a first plurality of warp restraints positioned at a first inner portion of the bolster and the first side frame, each of the plurality of first warp restraints including:

(a) a first bearing connected to the bolster and including a rotatable engagement roller, and (b) a second bearing connected to the first side frame, the second bearing including a removable engagement pad configured to be directly engaged by the engagement roller of the first bearing; and a second plurality of warp restraints positioned at a second inner portion of the bolster and the second side frame, each of the plurality of second warp restraints including:

(a) a first bearing connected to the bolster and including a rotatable engagement roller, and (b) a second bearing connected to the second side frame, the second bearing including a removable engagement pad configured to be directly engaged by the engagement roller of the first bearing.

11. The railroad car truck of claim 10, wherein the rotatable engagement roller of the first bearing is angled outwardly, angled inwardly, initially angled upwardly, initially angled downwardly, initially angled outwardly and upwardly, initially angled outwardly and downwardly, initially angled inwardly and upwardly, or initially angled inwardly and downwardly.

12. The railroad car truck of claim 10, wherein for each of the first warp restraints, the first bearing extends perpendicularly from the bolster, and for each of the second warp restraints, the first bearing extends perpendicularly from the bolster.

13. The railroad car truck of claim 12, wherein for each of the first warp restraints, the second bearing extends perpendicularly from the first side frame, and for each of the second warp restraints, the second bearing extends perpendicularly from the second side frame.

14. The railroad car truck of claim 10, wherein for each of the first warp restraints, the second bearing extends perpendicularly from the first side frame, and for each of the second warp restraints, the second bearing extends perpendicularly from the second side frame.

15. The railroad car truck of claim 10, wherein the first inner portions are inwardly of an inner surface of the first side frame, and the second inner portions are inwardly of an inner surface of the second side frame.

* * * * *